US011572766B2

(12) United States Patent
Lonnes

(10) Patent No.: US 11,572,766 B2
(45) Date of Patent: Feb. 7, 2023

(54) WAVEFORM ENERGY GENERATION SYSTEMS AND METHODS OF ENHANCING MATRIX PERMEABILITY IN A SUBSURFACE FORMATION

(71) Applicant: ExxonMobil Upstream Research Company, Spring, TX (US)

(72) Inventor: Steve Lonnes, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 17/444,479

(22) Filed: Aug. 5, 2021

(65) Prior Publication Data

US 2022/0074286 A1 Mar. 10, 2022

Related U.S. Application Data

(60) Provisional application No. 63/076,466, filed on Sep. 10, 2020.

(51) Int. Cl.
*E21B 41/00* (2006.01)
*E21B 43/263* (2006.01)
*E21B 17/08* (2006.01)

(52) U.S. Cl.
CPC ..... *E21B 41/0085* (2013.01); *E21B 17/08* (2013.01); *E21B 43/263* (2013.01)

(58) Field of Classification Search
CPC .... E21B 28/00; E21B 41/0085; E21B 43/003; E21B 17/08
See application file for complete search history.

(56) References Cited

U.S. PATENT DOCUMENTS

2004/0180793 A1* 9/2004 Ramos ..... C04B 38/00 507/200
2005/0050726 A1* 3/2005 Anderson ..... E21B 43/106 29/890.043
2015/0275628 A1* 10/2015 McGee ..... E21B 43/003 166/177.2

* cited by examiner

*Primary Examiner* — Kristyn A Hall
(74) *Attorney, Agent, or Firm* — ExxonMobil Upstream Research Company—Law Department

(57) ABSTRACT

A waveform energy generation system, the system including at least one joint of production casing, and one or more energy generators residing along the joint of production casing. The energy generators are configured to be in substantial mechanical contact with a subsurface formation within a wellbore. The energy generators may include either explosive devices or a piezo-electric material. The system also includes a signal transmission system. The signal transmission system is used to send control signals from the surface down to the energy generators for activation at the formation's resonant frequency. Methods of enhancing the permeability of a rock matrix within a subsurface formation using the wellbore as an energy generator are also provided.

25 Claims, 14 Drawing Sheets

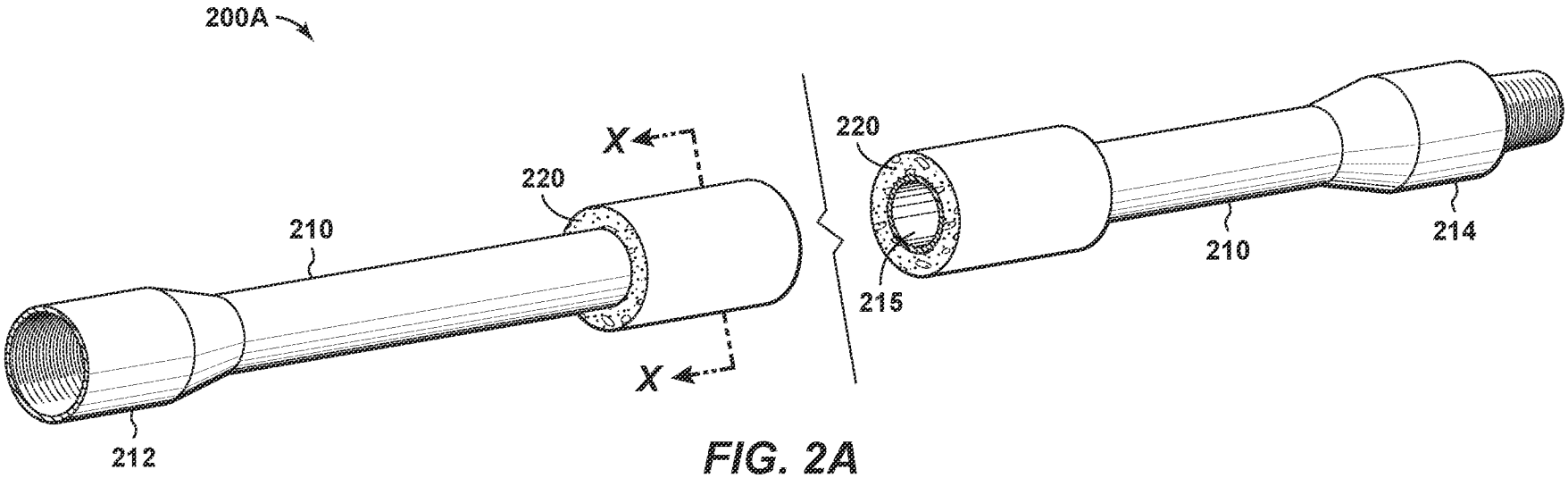
FIG. 2A
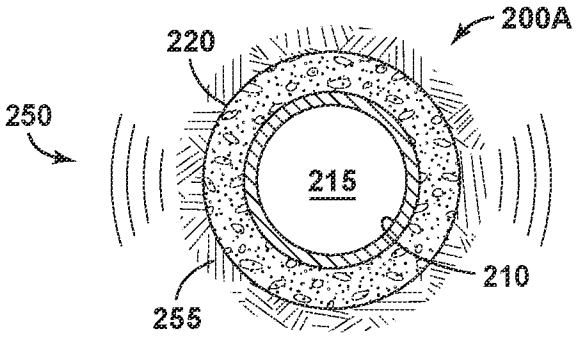
FIG. 2A-X

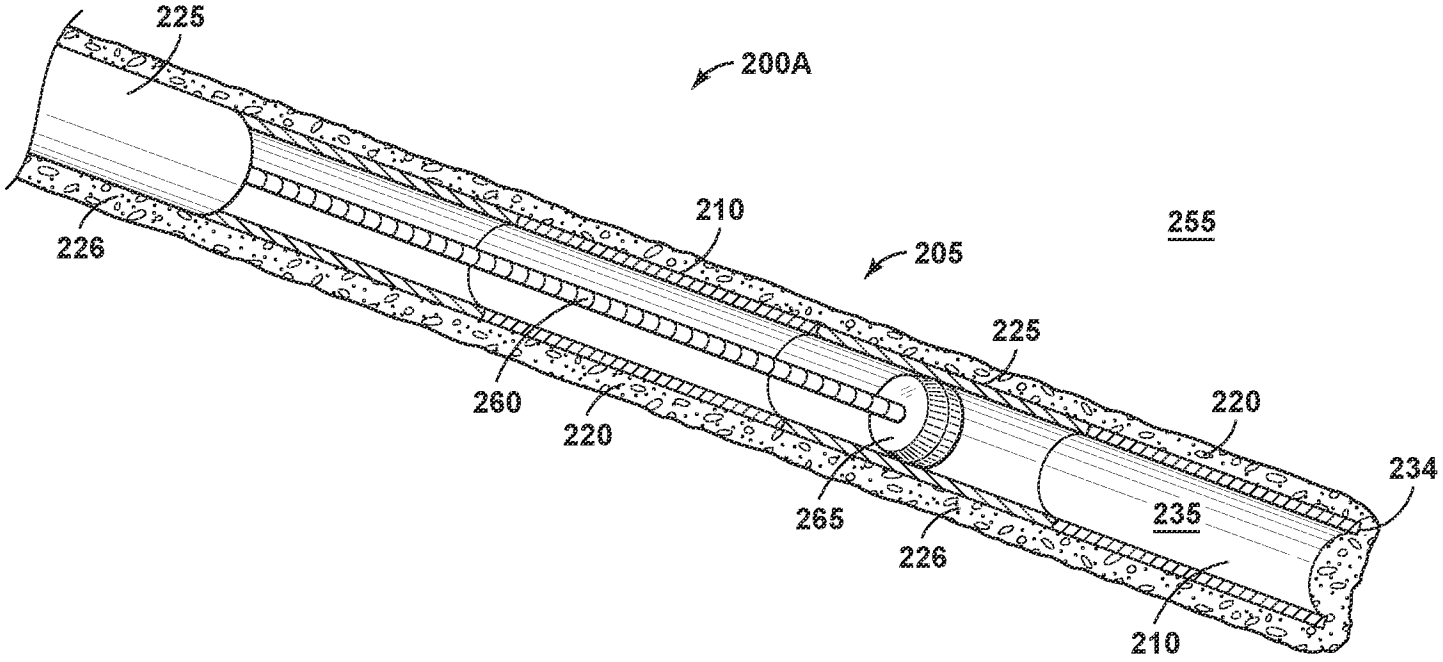
FIG. 2A-Y

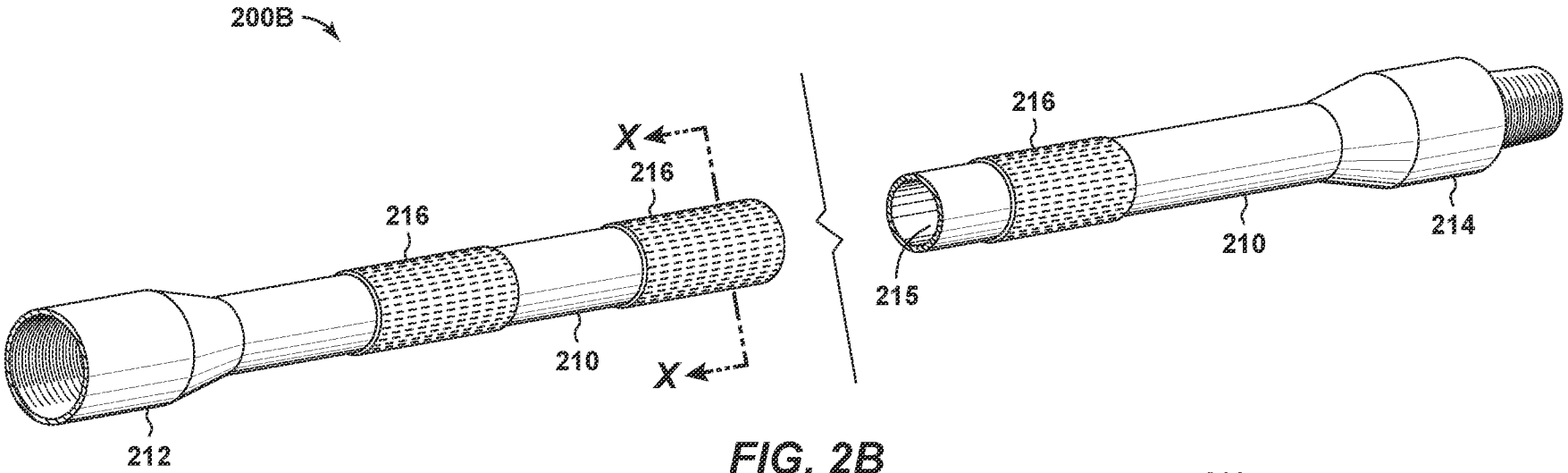
FIG. 2B
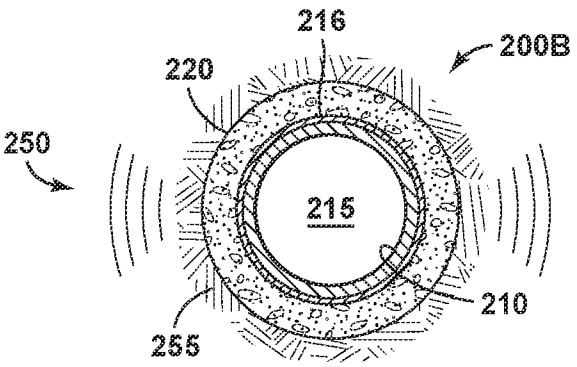
FIG. 2B-X

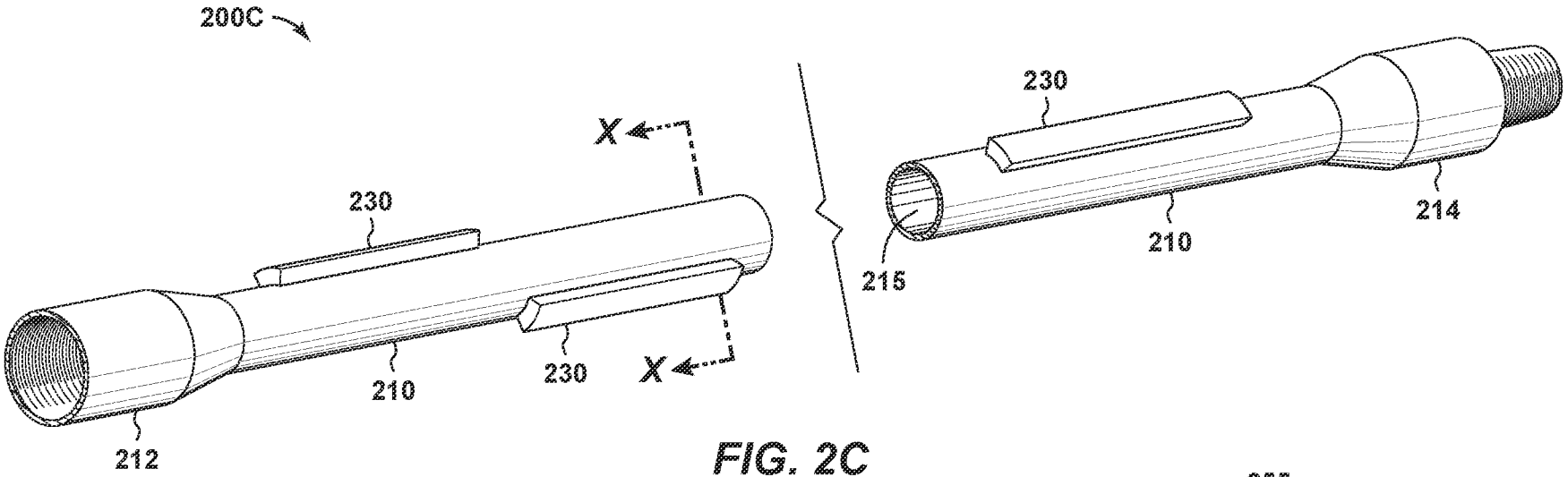
FIG. 2C
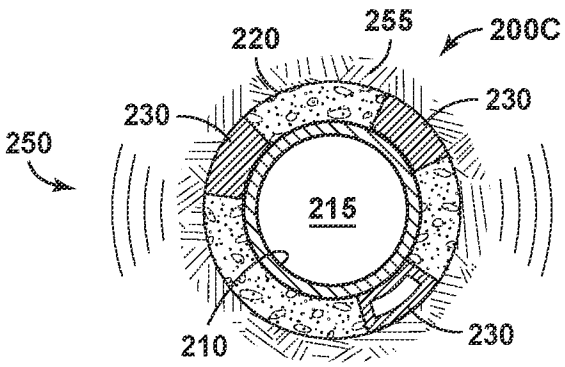
FIG. 2C-X

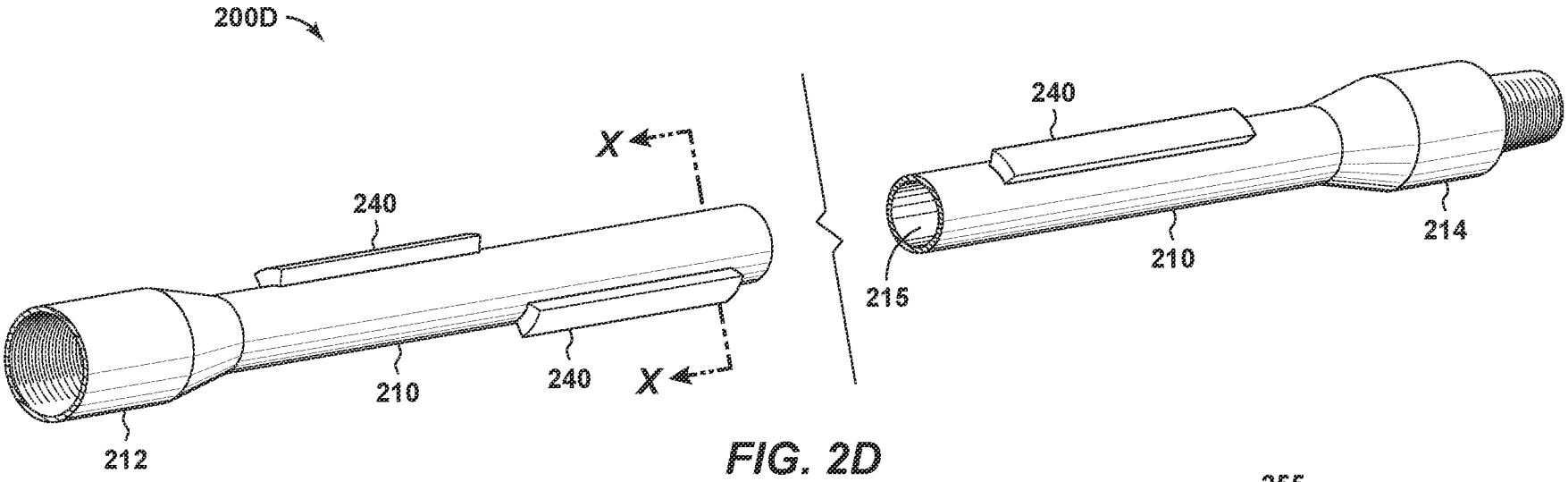
FIG. 2D
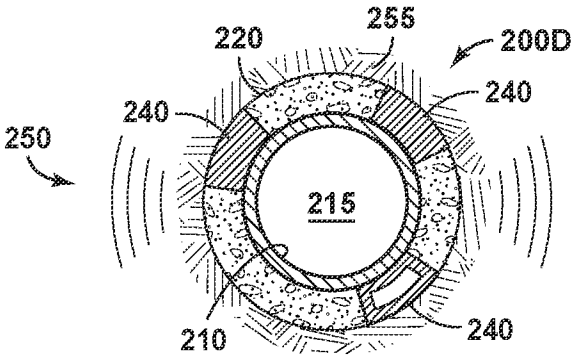
FIG. 2D-X

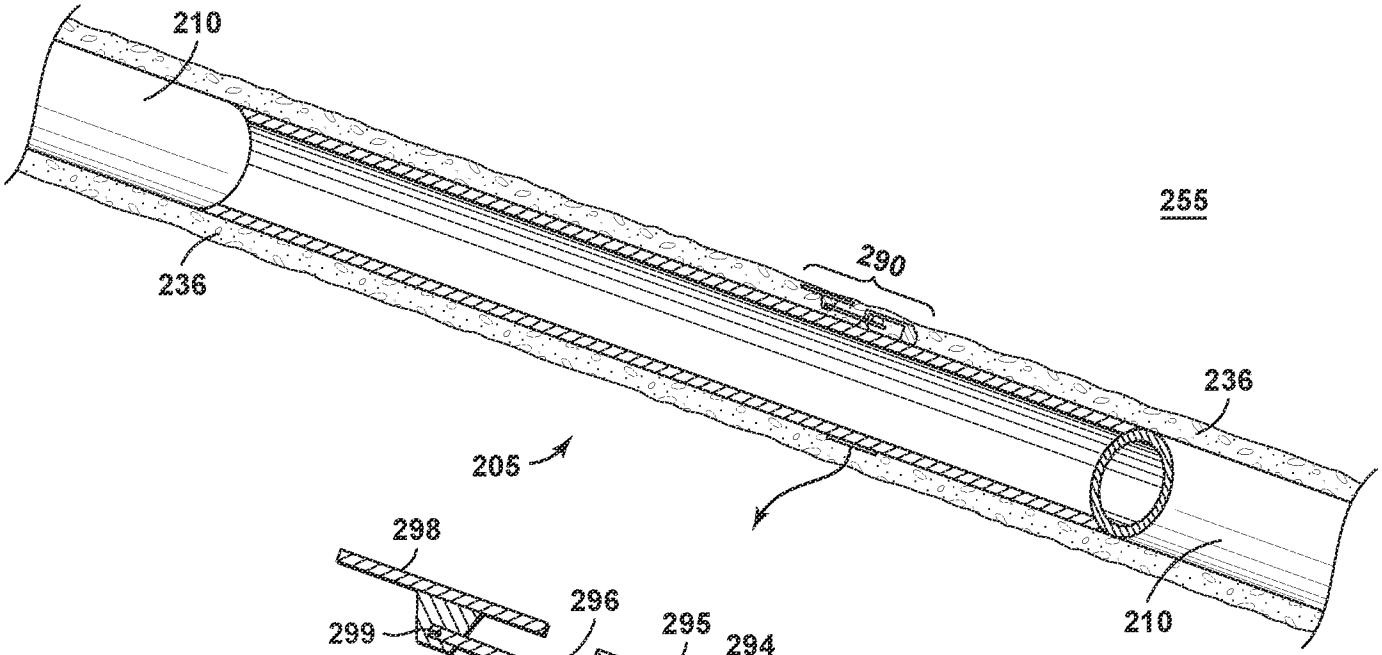
FIG. 2H
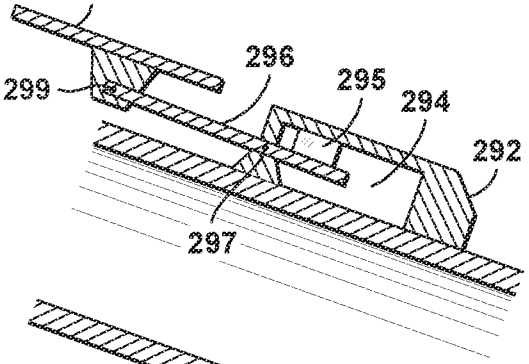
FIG. 2H - Z

WAVEFORM ENERGY GENERATION SYSTEMS AND METHODS OF ENHANCING MATRIX PERMEABILITY IN A SUBSURFACE FORMATION

CROSS-REFERENCE TO RELATED APPLICATIONS

This application claims the benefit of U.S. Provisional Application No. 63/076,466, filed Sep. 10, 2020, the disclosure of which is herein incorporated by reference in its entirety.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the present techniques relate to the development of unconventional hydrocarbon resources using mechanical wave energy applied directly to a formation. Still further, the present techniques relate to methods of increasing the effective permeability of a subsurface formation by leveraging the resonant frequency of the rock matrix using the wellbore itself as a waveform energy generator.

BACKGROUND OF THE INVENTION

In the completing of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing. The process of drilling and then installing casing is repeated until the wellbore has reached "total depth."

Advances in drilling technology have enabled oil and gas operators to "kick-off" and steer wellbore trajectories from a generally vertical orientation to a generally horizontal orientation. The horizontal "leg" of each of these wellbores now often exceeds a length of one mile, and sometimes two or even three miles. This significantly multiplies the wellbore exposure to a target hydrocarbon-bearing formation (or "pay zone"). As an example, consider a target pay zone having a (vertical) thickness of 100 feet. A one-mile horizontal leg exposes over 50 times as much pay zone to a horizontal wellbore as compared to the 100-foot exposure of a conventional vertical wellbore.

Within the United States, many wells are now drilled to recover oil and/or natural gas, and potentially natural gas liquids, from pay zones previously thought to be too impermeable to produce hydrocarbons in economically viable quantities. Such "tight" or "unconventional" formations may be sandstone, siltstone, or even shale formations. Alternatively, such unconventional formations may include coalbed methane. In any instance, such formations have "low permeability," such as less than 0.1 millidarcies.

In order to enhance the recovery of hydrocarbons, particularly in low-permeability formations, stimulation techniques may be employed in the pay zone. Such techniques include hydraulic fracturing. Hydraulic fracturing causes multiple fractures to be formed along the length of a horizontal wellbore, forming so-called frac-wings. The frac-wings typically form vertically at the wellbore and then propagate both horizontally away from the wellbore and vertically above and below the wellbore, creating in essence multiple vertical completions.

The ability to replicate multiple vertical completions along a single horizontal wellbore is what has made the pursuit of hydrocarbon reserves from unconventional reservoirs, and particularly shales, economically viable within relatively recent times. In the United States, total frac stages have been increasing by over 10% per year. In addition, well over two-thirds of all wells now drilled in the United States are completed horizontally, and fractured.

While formation fracturing technology has been highly successful in exposing the wellbore to a greater percentage of the rock formation, allowing the industry to substantially increase the production of hydrocarbon fluids in recent years, it is also known that wells completed in many unconventional reservoirs have a high terminal decline rate. For example, horizontally completed wells in the Permian Basin frequently produce 40% of the oil and gas they are expected to produce over their lifetime in the first 36 months.

The approach used by the industry to offset the negative economic impact of the high decline rate has been to increase the production from each well by increasing the contact/production area within the formation through longer horizontal wells with more frac stages are being completed. At the same time, higher volumes of sand are being mixed with the fracturing fluid to prop the fractures open after the injection pressure is released. In some cases, wells may be re-fractured after a period of production.

The hydraulic fracturing (and sometimes re-fracturing) of the formation requires large volumes of water along with large volumes of sand. The process of fracturing necessarily leaves virgin rock between the fracture planes. Therefore, a need exists for an improved well completion that provides for a wave energy source that is in direct contact with the rock matrix, wherein the wave energy breaks apart pre-existing or naturally occurring weaknesses in the matrix, fault lines, and/or fissures. Further, a need exists for a method of increasing formation fracture complexity, during or after well completion, by applying wave energy directly to the surrounding rock matrix in order to break down the rock matrix and enhance formation permeability. A need additionally exists for such a method that supplements hydraulic fracturing as a means of increasing matrix permeability.

SUMMARY OF THE INVENTION

A waveform energy generation system is first provided herein. The energy generation system is designed to reside within a wellbore, and to generate waveform energy directly into a subsurface formation (adjacent to the wellbore). The energy generator is tuned to distribute the waveform energy into the formation at a resonant frequency of the rock matrix. The application of mechanical energy at resonant frequency causes the cementitious minerals to fail, opening up naturally occurring cemented and uncemented fractures within the subsurface formation.

In one embodiment, the energy generator comprises tubular bodies fabricated from a piezo-electric material. The tubular bodies are placed in series with the standard joints of steel casing within the wellbore. Preferably, a plurality of tubular bodies fabricated from a piezo-electric material are threadedly connected between selected joints of steel casing. Such tubular bodies may be in the form of short subs fabricated from metal. A voltage is then applied across the piezo-electric material, causing the tubular bodies to vibrate, that is, to expand and contract, at a selected resonant frequency.

In this embodiment, the piezo-electric material forms, or is fabricated to be a component of, a series of solid tubular bodies that essentially form a part of the production casing. The production casing may be cemented into place within the pay zone. Alternatively, the production casing may employ swellable packers for zonal isolation. In either instance, the piezo-electric tubular bodies are in substantial mechanical contact with the rock wall that surrounds the wellbore.

In another aspect, the energy generator comprises a piezo-electric material that is attached to the outside of selected joints of casing. Here, piezo-electric bodies in the form of pads or in the form of radial sleeves are used. These pads or sleeves engage the formation, either directly or via the engulfing cement column, providing a mechanical connection to the rock wall, or borehole.

In a related embodiment, the pads or radial sleeves reside along the outer diameter of selected joints of casing, with the joints of casing having been expanded. The pads or sleeves tightly engage the surrounding formation when the casing is expanded, such as through the use of a swage.

In another embodiment, the energy generator comprises a plurality of explosive devices. Each explosive device resides within a separate housing fixed along selected joints of production casing. The housings may extend out from the outer diameter of the production casing towards the surrounding borehole or subsurface formation. Preferably, at least three separate explosive devices reside along each of the selected joints of production casing. In this way, a long, explosives-laden string is formed in the wellbore.

In another embodiment, the energy generator comprises a piezo-electric material (or piezo-electric particles) placed within the surrounding column of cement. The cement column resides between the joints of production casing and the borehole within the pay zone. The piezo-electric particles are mixed into a cement slurry at the surface before the cement is squeezed into the annular region between the production casing and the borehole. The piezoelectric material in the cement is activated by establishing a voltage difference between the production casing and the formation.

It is understood that the energy generation systems described herein may actually comprise a plurality of waveform energy generators residing along a plurality of respective joints of production casing. Each waveform energy generator receives an actuation signal. Separate signals may be sent from the surface to the waveform energy generators along the wellbore, either simultaneously or in separate stages.

The waveform energy generation system additionally preferably includes a signal transmission system. The signal transmission system is configured to send power and control signals from the surface, down the wellbore, and to the energy generators for activation. In one aspect, the signal transmission system comprises an electric line that is pumped into the wellbore to selected depths. An electric probe, or transmitter, resides at a distal end of the electric line for transmitting electrical energy to the waveform energy generator. In another aspect, the signal transmission system is an electric cable residing on an outer diameter of a string of production casing placed within the wellbore. A plurality of clamps may be spaced apart along the string of production casing for securing the electric cable to the outer diameter. Of interest, the clamps may also act as mechanical connection points between the tubulars and the borehole wall. The signals may be sent from a subsurface module that machine learns the resonant frequency of the formation and then drives the energy generation system.

In the context of the explosive devices, these devices may be detonated by signals sent via electric line from the surface. Alternatively, the devices may be detonated from a transmitter device in the form of an electric probe that is pumped downhole and that detonates the charges as it passes by on its way to the toe of the well. Alternatively still, the explosive devices may be detonated when the transmitter device is pulled up-hole from the toe, activating the charges as it passes by.

A method of enhancing permeability within a subsurface formation is also provided herein. In one embodiment, the method first includes placing a waveform energy generator in a wellbore. The energy generator is in mechanical contact with a borehole along the wellbore. The energy generator may be in accordance with any of the waveform energy generators listed above.

The method additionally includes determining a resonant frequency of a rock matrix within the subsurface formation. This may be done by correlating a known resonant frequency with the lithology identified in the formation. More preferably, this is done by transmitting broadband wave energy into the formation, and then listening for, or detecting, vibrational frequencies within the formation using a piezo-electric sensor. The vibrational frequencies are filtered to identify the resonant frequency within a formation, or the resonant frequencies associated with each geologic layer that comprises a formation.

The method also comprises sending a control signal down the wellbore. The control signal activates the waveform energy generator, wherein the energy generator is configured to send waveform energy into the subsurface formation at a frequency that approximates the resonant frequency of the rock matrix.

The method further includes applying waveform energy from the energy generator into the rock matrix. The energy is applied for a sufficient period of time to increase effective permeability of the rock matrix. Preferably, waveform energy is distributed into the formation from a plurality of energy generators spaced apart along a horizontal portion of the wellbore. There may be multiple wave generators operating at different frequencies that are tuned to various rock types in the formation.

BRIEF DESCRIPTION OF THE DRAWINGS

So that the manner in which the present techniques can be better understood, certain illustrations, charts and/or flow charts are appended hereto, which may be referred to collectively as Figures or FIGs and individually as a Figure or FIG. It is to be noted, however, that the drawings illustrate only selected embodiments of the inventions and are therefore not to be considered limiting of scope, for the inventions may admit to other equally effective embodiments and applications.

FIG. 2A is a perspective view of a joint of production casing. The casing is set within a cement matrix, partially shown. The cement matrix comprises piezo-electric material that may be electrified to generate waveform energy.

FIG. 2A-X is a cross-sectional view of the production casing of FIG. 2A, taken across Line X-X.

FIG. 2A-Y provides a perspective view of a string of production casing. The production casing has been set into a pay zone. The production casing has been cemented into a borehole, with portions of the cement column having piezo-electric particles. An electric probe has been pumped into the wellbore to activate the particles.

FIG. 2B is a perspective view of a joint of production casing in a second embodiment. In this view, piezo-electric material is provided along selected portions of the casing in the form of either fixed pads or radial sleeves.

FIG. 2B-X is a cross-sectional view of the production casing and radial sleeves of FIG. 2B, taken across Line X-X.

FIG. 2C is a perspective view of a joint of production casing in a third embodiment. In this view, acoustic devices are placed along an outer diameter of the production casing.

FIG. 2C-X is a cross-sectional view of the production casing and acoustic devices of FIG. 2C, taken across Line X-X.

FIG. 2D is a perspective view of a joint of production casing in a fourth embodiment. In this view, explosive devices are placed along an outer diameter of the production casing.

FIG. 2D-X is a cross-sectional view of the production casing and explosive devices of FIG. 2D, taken across Line X-X.

FIG. 2H is yet another perspective, cut-away view of the string of production casing of FIG. 2E. In this case, a mechanical device is secured to an outer diameter of the casing. The mechanical device resides in the annulus and houses a piezo-electric material.

FIG. 2H-Z presents an enlarged view of a portion of the string of production casing from FIG. 2H. Features of the mechanical device are more clearly seen.

DETAILED DESCRIPTION OF THE INVENTION

Figure 1:
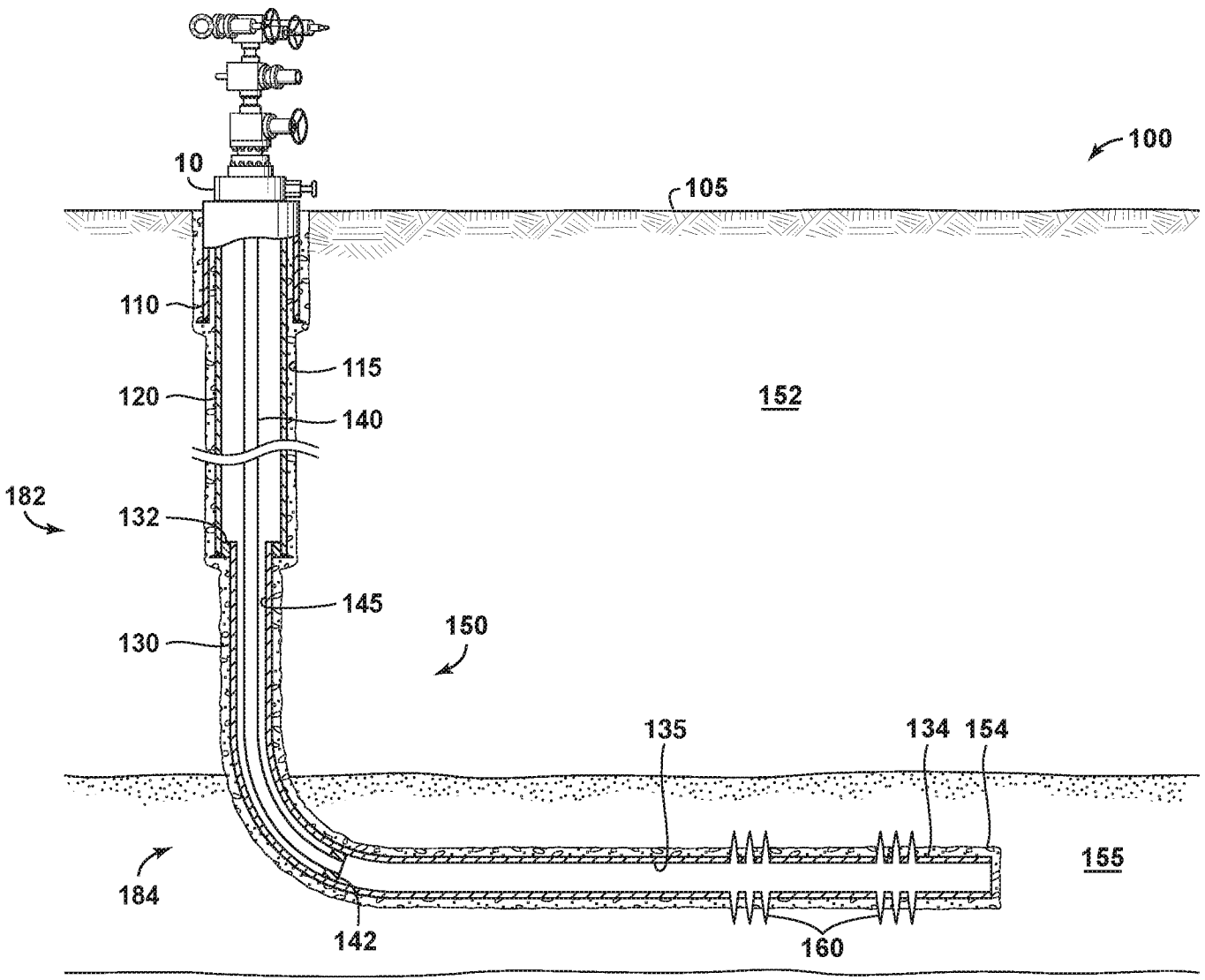
FIG. 1 is a cross-sectional view of a wellbore. The wellbore has undergone completion, and has a horizontal section. Production casing along the horizontal section has been perforated, with perforations extending out into the surrounding borehole or subsurface formation.

Various terms as used in the specification and in the claims are defined below. To the extent a term used in the claims is not defined below, it should be given the broadest reasonable interpretation that persons in the upstream oil and gas industry have given that term as reflected in at least one printed publication or issued patent.

For purposes of the present application, it will be understood that the term "hydrocarbon" refers to an organic compound that includes primarily, if not exclusively, the elements hydrogen and carbon. Hydrocarbons may also include other elements such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state, or combination thereof.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and fines, combinations of liquids and fines, and combinations of gases, liquids, and fines.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

The term "sand" refers to any granular material containing quartz or silica (meaning a combination of silicon and oxygen, or $SiO_2$). Non-limiting examples include "Northern White" sand and or West Texas eolian sand. Sand is one form of proppant that may be used in a formation fracturing operation.

The term "aggregate" refers to an inorganic mixture containing sand.

As used herein, the term "wellbore" refers to a hole in the subsurface made by drilling or insertion of a conduit into the subsurface. The term "well," when referring to an opening in the formation, may be used interchangeably with the term "wellbore." The term "wellbore" is commonly used in industry to refer to a hole that has been drilled and is undergoing completion, or has been completed.

The term "borehole" refers to the generally cylindrical opening formed by the drilling of the wellbore. The borehole has a rock face. Thus, an object being in contact with the borehole means that it is in contact with one or more rock formations.

A "well site" is a surface area where a wellbore is being or has been formed.

The terms "resonant frequency" and "resonance frequency" are intended to be synonymous. Both terms are used in technical literature as pertaining to the application of wave energy to a body. In the present disclosure, Applicant has generally used the term "resonant frequency."

Description of Selected Specific Embodiments

Described herein are unique and novel methods of enhancing permeability of a rock matrix within a hydrocarbon-bearing formation. The methods are conducted in a wellbore before, during or after a completion operation. For example, each of the methods may be conducted prior to a hydraulic fracturing operation, or after a hydraulic fracturing operation to enhance effective permeability.

The methods herein apply a mechanical wave energy into the rock matrix surrounding a wellbore. Of interest, the methods utilize various forms of energy generators placed in contact with the borehole, or rock matrix, surrounding the wellbore.

FIG. 1 is a cross-sectional view of an illustrative well site 100. The well site 100 includes a wellbore 150 having been formed from the surface 105 of the Earth, and down into a subsurface formation 152. The wellbore 150 penetrates through the subsurface formation 152, and down to a subsurface formation 155. The subsurface formation 155 represents a hydrocarbon-bearing rock matrix, and may be referred to in the industry as a "pay zone."

The wellbore 150 has been completed as a cased-hole completion for producing hydrocarbon fluids. For this purpose, the well site 100 includes a wellhead 10 situated at the surface 105. The wellhead 10 is shown schematically, and is representative of any structure that may be placed over a wellbore. For example, the wellhead 10 may be a lubricator used during a well workover operation. Alternatively still, the wellhead 10 may be a control valve placed at the surface 105 to control wellbore pressures and to receive produced fluids from a subsurface formation 155. An example may be a so-called Christmas tree. A Christmas tree is typically used when the subsurface formation 155 has enough in situ pressure to drive production fluids from the subsurface formation 155 or when an artificial lift approach such as gas-lift is applied, up the wellbore 150, and to the surface 105.

It is understood that rather than using a Christmas tree, the well head 10 may alternatively include a motor (or prime mover) at the surface 105 that drives a pump as part of artificial lift. The pump reciprocates a set of sucker rods and a connected positive displacement pump (not shown) downhole. The pump may be, for example, a rocking beam unit or a hydraulic piston pumping unit. Alternatively still, the well head 10 may be configured to support a string of production tubing having a downhole electric submersible pump or other means of artificial lift (not shown). The present techniques are not limited by the configuration of operating equipment at the surface.

As shown in FIG. 1, the wellbore 150 has been completed with a series of pipe strings, referred to as casing. First, a string of surface casing 110 has been cemented into the subsurface formation 152. Cement is shown in an annular bore between a wall of the borehole 115 of the wellbore 150 and the surface casing 110. The wall is indicative of a borehole 115.

The surface casing 110 has an upper end in sealed connection with the wellhead 10. Similarly, the surface casing 110 has a lower end that includes a cement shoe (not numbered but well understood to those of ordinary skill in the art.)

Next, at least one intermediate string of casing 120 is cemented into the wellbore 150. The intermediate string of casing 120 is in sealed fluid communication with the wellhead 10, such as through an upper master valve. Cement is again shown along the borehole 115 of the wellbore 150. The combination of the casing strings, such as surface casing 110 and intermediate string of casing 120, and the cement sheath in the borehole 115 strengthens the wellbore 150 and facilitates the isolation of formations behind the casing 110, 120.

It is understood that a wellbore 150 may, and typically, includes more than one string of intermediate casing. Some of the intermediate casing strings may be only partially cemented into place, depending on regulatory requirements and the presence of migratory fluids in any adjacent strata.

Finally, a production liner 130 is provided. The production liner 130 is hung from the intermediate string of casing 120 using a liner hanger 132. A portion of the production liner 130 may optionally be cemented in place. The production liner 130 is a string of casing that is not tied back to the surface 105.

The production liner 130 has a lower end 134 that extends substantially to an end, or toe, 154 of the wellbore 150. For this reason, the wellbore 150 is said to be completed as a cased-hole well. Note that some wells use production casing instead of a production liner. Production casing does not have a liner hanger; rather, it runs from the surface 105 down to the toe 154 or lower end 134 of the wellbore 150 or, in the case of an open hole completion, to the pay zone of the subsurface formation 155.

The illustrative wellbore 150 has been completed horizontally. This means the wellbore 150 has a vertical section 182 and a horizontal section 186 forming what is sometimes referred to as a lateral. A transition section 184 is formed between the vertical section 182 and horizontal section 186. The horizontal section 186 extends along the pay zone of the subsurface formation 155, and terminates at the toe 154. A pump (not shown) is typically landed in the transition section 184, preferably as deep as possible—and close to the horizontal section 186. Horizontal completions are common for wells that are completed in so-called "tight" or "unconventional" formations.

In order to provide fluid communication between the production liner (or production casing) 130 and the subsurface formation 155, the production liner 130 has been perforated. A series of perforations 160 are shown along the production liner 130. Those of ordinary skill in the art will understand that the horizontal section 186 may extend, one, two, or even three miles in length, and numerous perforations 160 may be applied along the horizontal section 186. In addition, horizontally-completed wells also typically undergo a formation fracturing operation, with the perforating and fracturing process being conducted in multiple stages.

It is also noted that in lieu of using production casing with perforations 160, the production liner 130 may be or may include sections of slotted liner to create fluid communication between a bore 135 of the production liner 130 and the surrounding rock matrix making up the subsurface formation 155. Alternatively still, the wellbore 150 may include sliding sleeves that can be opened to provide communication between the well and the formation, or may include burst disks that are opened when an elevated pressured is applied.

The wellbore 150 also includes a string of production tubing 140. The production tubing 140 extends from the well head 10 down to the subsurface formation 155. Although not shown in the arrangement of FIG. 1, it is common for the production tubing 140 to terminate proximate an upper end of the subsurface formation 155. In any instance, a production packer 142 is provided at a lower end of the production tubing 140 in most well designs to seal off an annular region 145 between the production tubing 140 and the surrounding casing or production liner 130.

In addition to using the formation's natural permeability and reservoir pressure to drive formation fluids to the bore 135 of the production liner 130, and in addition to using perforations 160 and/or sliding sleeves and/or burst disks and any fracturing process that may have been employed, it is proposed herein to apply energy to the rock matrix making up the subsurface formation 155. The frequency of the energy is tuned to a resonant frequency of the rock matrix itself. In one embodiment herein, the operator (such as the operator's geologist or geophysicist) may determine the resonant frequency or frequencies of the rock matrix within the pay zone of the subsurface formation 155.

Various embodiments for systems and methods for applying waveform energy into the subsurface formation 155 are offered herein. By applying waveform energy at the resonant frequency of the rock matrix, the operator is able to take advantage of the destructive forces created by matching waveform energy with resonant frequency, creating cracks in the matrix and increasing the effective permeability of the formation. In some instances, the methods may create movement within portions of the formation that are critically stressed. This may be done either before or after a formation fracturing operation.

FIG. 2A is a perspective view of a joint of production casing 200A. The production casing 200A defines an elongated pipe joint fabricated from either a conductive or a non-conductive material. The production casing 200A has a first end 212, typically referred to as the box end. The box end 212 serves as the female portion of a threaded coupling. The production casing 200A further has an opposing second end 214, typically referred to as a pin end. The pin end 214 serves as the male portion of a threaded coupling.

The production casing 200A comprises an elongated tubular body 210 intermediate the first end 212 and second end 214. A bore 215 is formed within the tubular body 210. The joint of production casing 200A is configured to be run into a wellbore (such as wellbore 150 of FIG. 1) as is well known in the art. Upon being set in the wellbore, the bore 215 of the production casing 200A receives production equipment such as a production tubing (shown at 140 in FIG. 1).

It is understood that the joint of production casing 200A may represent a series of tubular bodies threadedly joined end-to-end. Upon being set in the wellbore, a column of cement is set around the production casing 200A. In FIG. 2A, portions of a cement column 220 are shown around the tubular body 210. It is understood that in a typical completion, the cement column 220 may run along the outer diameter of the casing string for perhaps as many as 10,000 feet, or more.

In the illustrative arrangement of FIG. 2A, the cement column 220 is formed from a matrix containing piezo-electric material. The piezo-electric material constitutes flakes, beads or shards of material designed to be energized in response to receiving an electrical signal. By way of background, piezo-electric materials activate when a voltage is applied across them. In this instance, a voltage difference is applied across piezo-electric particles contained in the cement column 220. This is done by crafting the cement material to be resistant to electrical current while also being compliant to expansion and contraction. A voltage drop occurs from the production casing 200A to the formation (across the cement column 220) when a source voltage is applied at the production casing 200A.

Preferably, the piezo-electric material comprises or constitutes mixtures of the elements Titanium, Zirconium and Lead. The mixture may be, for example, lead zirconate titanate ($Pb[Zr_xTi1-_x]O_3$, or PZT), which is a ceramic perovskite material. Alternatively, the mixture may be barium titanate ($BaTiO_3$), which is a ferro-electric ceramic material. Alternatively still, the mixture may be lithium tantalite ($LiTiO_3$), which is a perovskite material having both piezo-electric and pyro-electric properties. Additional optional materials include potassium niobate ($KNbO_3$), lithium niobate ($LiNbO_3$) and sodium tungstate ($Na_2WO_3$). Certain piezo-electric crystals such as quartz ($SiO_2$) are also suitable. Combinations of such materials may also be employed in the cement column 220 to form a pulsating medium capable of sending waveform energy into a surrounding formation 155.

In one aspect, the piezo-electric materials expand and contract at frequencies in the kilohertz range. By energizing the particles in the cement column 220 at a selected voltage oscillation frequency, the operator can generate waveform energy into the surrounding rock matrix in the subsurface formation 155 at the matrix' resonant frequency. This may be referred to herein as resonant frequency energy.

FIG. 2A-X is a cross-sectional view of the production casing 200A. This view is taken across Line X-X of FIG. 2A. In this view, the piezo-electric particles in the cement column 220 have been energized. Energy waves 250 are shown moving away from the production casing 200A and into the formation. Preferably, the subsurface formation 255 is a low-permeability (or "tight") formation.

It is observed that most unconventional formations reside in a tectonically induced anisotropic stress-state, meaning the stresses in one direction of the formation are different than the stresses prevailing from other directions. This inherent stress anisotropy aids in the creation of cracks and fissures due to the stress gradients naturally positioning the rock closer to its failure point. In the present techniques, resonance-induced mechanical energy pushes the strained/stressed rock beyond its failure point, whether that failure is through shear failure, tensile failure or both.

It is further observed that most natural fractures in unconventional formations are in a closed state due to cementitious material residing along the cracks. Such cementitious material includes calcite and other minerals. However, the mechanical strength of these minerals can be lower than the rock matrix itself. Thus, the application of mechanical energy at resonant frequency can fail the cementitious minerals, opening up higher conductivity pathways to the wellbore. Most of these pathways may not be opened up solely through hydraulic fracturing.

The most readily accessible failure points for waveform energy may be natural fractures that are critically stressed, that is, fractures already residing near their failure point.

Subsequent weak points may become compromised with increasing mechanical energy accumulation in the rock, thus creating a more extensive permeability-enhancing crack network than may otherwise exist through hydraulic fracturing alone.

In order to supply the energy needed to generate the mechanical waves, such as energy waves 250 to the cement column 220, the operator may send electrical current down the wellbore 150. In one aspect, this is done by sending signals down the production casing or production liner 130 itself. It is known to provide wellbore telemetry through pipe strings using electro-magnetic frequencies or acoustic frequencies. U.S. Pat. No. 10,364,669 presents an example of the latter. Alternatively, electro-acoustic signals may be delivered such as is taught in U.S. Pat. No. 10,167,717.

In another aspect, signals are sent by delivering an electrical probe into the wellbore at the end of an e-line. FIG. 2A-Y provides a perspective view of the string of production casing 200A having been set in a pay zone of the subsurface formation 255. The production casing 200A comprises a series of pipe joints threadedly connected, end to end. The production casing 200A has been cemented into a borehole 205, with a cement column being shown at 220.

As part of the production casing 200A, pipe joints, each having a tubular body 210 from FIG. 2A, are interspersed. Here, the pipe joints represents short tubular bodies 210 fabricated from a non-conductive material. These joints or tubular bodies 210 are placed at selected depths along the wellbore. Around joints or the tubular bodies 210, the cement column 220 from FIG. 2A has been placed. The cement column 220 includes piezo-electric particles. In addition, the production casing 200A includes joints of conductive tubular bodies of the pipe joints 225. Traditional non-conductive cement 226 designed to be compliant to expansion and contraction is optionally placed around the tubular bodies of the pipe joints 225.

In one aspect, in order to activate the piezo-electric particles an electric probe 265 is provided. The electric probe 265 is pumped down into the production casing 200A and through a bore 235 at the end of a working string 260. In the arrangement of FIG. 2A-Y, the working string is an electric line 260. The e-line 260 represents a heavily insulated electrical cable. In this instance, the electric probe 265 is pumped into the wellbore to a designated depth, and then placed into contact with the production casing 200A at a desired depth. For example, a docking arrangement is provided that allows the probe 265 to land onto joint of casing or tubular body 210 and to provide the desired electrical connection. Current is then sent through the electric cable 260. Current passes across the non-conductive pipe or tubular body 210 and into the surrounding cement column 220. In addition, there could be numerous contact points along the length of the lateral that may facilitate the creation of a resonant frequency along the length of the lateral.

It is observed that this same approach could also be done using a coiled tubing string (not shown) as the working string. In this instance, the coiled tubing string includes an electric transmission line inside the coiled tubing or integrated into its wall. Alternatively, an insulated electrically conductive cable may be strapped along the length of jointed tubing and run into the wellbore as the working string.

In a more preferred embodiment, delivery of electrical signals to the piezo-electric components is achieved by strapping an electrical cable 260 to the outside wall of the production casing 200A. This is done while the joints of casing are being run into the wellbore during completion, such as in the same way as cable is installed for downhole pressure/temperature gauge cable. In this instance, the cable clamps may be used to hold the electric cable.

Circuitry is provided to send control signals downhole, preferably in the form of pulses, wherein the term pulse includes periodic continuous signals such as sinusoidal signals. The circuitry generates short, large amplitude electric pulses, which are converted into short sonic to ultrasonic pulses (e.g., in a range between about 1 kHz and about 15 MHz, in a range between about 2 kHz and about 5 MHz, in a range between about 10 kHz and about 30 kHz, or any value therein) when applied to a piezo-electric transducer. In one aspect, the pulsing circuitry utilizes one or more multi-channel amplifiers for increasing the power of the signals for creating mechanical vibrations in the piezo-electric transducers. This, in turn, increases the amplitude of the mechanical vibrations of the piezo-electric transducers. Thus, the control signals induce high frequency mechanical vibrations in the piezo-electric transducers.

In operation, the operator energizes the piezo-electric material to "broadcast" a frequency sweep representing a broad range of frequencies into the formation. The piezo-electric transducers are tuned to a range of sonic and/or ultra-sonic vibrational frequencies. The transducers may be variable window piezo-electric transducers that vary in the frequency ranges in which they can produce and detect vibrations.

After a period of time, such as one hour, the control signals are discontinued, and the piezo-electric material then "listens" for frequencies that return from the formation to deduce the formation's resonant frequency (e.g., monitors frequencies received). In this respect, piezo-electric materials can be used not only as "transmitters," but also as "receivers." Piezo-electric materials acting as transmitters may generate a strain proportional to the electrical signal applied to them. Piezo-electric materials acting as receivers create a voltage proportional to the deformation induced by the mechanical strain applied to them by via vibration. Beneficially, the electrical cable 260 serves as both a control line (sending electrical command signals into the wellbore to generate vibrations within a desired frequency range) and a sensor line (allowing the piezo-electric material to return electrical signals to the surface 105 indicative of vibrational frequencies detected in the rock matrix in the subsurface formation 255).

Signal filtering and amplification circuitry is provided at the surface to receive and interpret electrical signals from the downhole piezo-electric particles, acting as transducers. The circuitry may include a frequency-spectrum analyzer, an attenuator, one or more amplifiers, and a wave filter. The frequency-spectrum analyzer receives the electrical signals generated by the piezo-electric transducers, and converts them into digital frequency data that can be displayed on a display device. The amplification circuitry increases the magnitude of the electrical signals from the piezo-electric transducers. The amplification circuitry may include one or more multi-channel amplifiers to amplify the voltage signals produced by the piezo-electric transducers downhole and sent to the receiver circuitry at the surface such as through an electrical line communicating with the lateral in the subsurface formation. Signals may be received and analyzed from the piezo-electric particles at different depths simultaneously to identify the resonant frequency of the rock matrix.

It is noted that in the illustrative arrangement of FIG. 2A-Y, the cement column 220 having piezo-electric particles is spaced-apart between columns or sections of cement 226 not having piezo-electric particles. However, it may be preferred and much simpler to just pump a continuous cement column 220 having the piezo-electric particles along most or all of the horizontal leg in the pay zone in the subsurface formation 255.

Once the resonant frequency is known, or a set of resonant frequencies are known, the piezoelectric material is used to deliver the select resonant frequency(ies) into the subsurface formation 155 for an extended period of time. Such a time may be, for example, at least one week, or multiple weeks or even months.

In the arrangements of FIGS. 2A and 2A-Y, the cement column 220 serves as the medium for generating waveform energy into the surrounding rock matrix in the subsurface formation 255. However, other systems and methods are offered herein for delivering wave energy into a formation through the excitation of piezo-electric materials. FIG. 2B is a perspective view of a joint of production casing 200B in a second embodiment. The joint of production casing 200B again includes a tubular body 210 having opposing first end 212 and second end 214. In this view, piezo-electric material is provided along discrete portions 216 of the production casing 200B.

The discrete portions 216 may represent areas along the tubular body 210 of the production casing 200B where piezo-electric material is located, such as by a coating. Alternatively, the discrete portions 216 may represent pads that are rotationally fixed along the outer diameter of the tubular body 210, such as by an adhesive connection or a friction fit. Alternatively still, the discrete portions 216 pay represent sleeves slidably placed along the outer diameter of the tubular body 210. Such discrete portions 216 of the sleeves may permit a degree of axial and/or rotational movement relative to the tubular body 210 to facilitate the transfer of mechanical energy into the subsurface formation 255.

In any of these options for FIG. 2B, the piezo-electric device may be primarily metal in construction to enable connection to the tubular string, but radial oscillatory movement is driven by the integral piezo-electric material. This mechanical device may be assembled from independent circumferentially adjacent segments or pads that contact the surrounding formation and expand and contract according to the driving signal (or control signal) that activates the internal piezo-electric material subcomponent(s) of the device.

FIG. 2B-X is a cross-sectional view of the production casing 200B of FIG. 2B, with the view taken across Line X-X. In this view, the piezo-electric particles in the discrete portions 216 (and, optionally, in the cement column 220) have been energized. Energy waves 250 are shown moving away from the production casing 200B and into the subsurface formation 255. Again, the formation is preferably a low-permeability (or "tight") formation.

FIG. 2C is a perspective view of a joint of production casing 200C in a third embodiment. In this view, acoustic devices 230 are secured to the production casing 200C. Each of the acoustic devices 230 comprises an elongated housing, or node, residing along an outer diameter of the production casing 200C. The acoustic devices 230 are dimensioned to contact the surrounding borehole when the production casing 200C is cemented into place within the wellbore.

Within each of the housings of the acoustic devices 230 is an acoustic energy generator. The acoustic energy generator of the acoustic device 230 may be, for example, an air gun. Upon detonation, each acoustic energy generator of the acoustic device 230 may apply between about 100 kHz and 1,000 kHz over a duration needed to grow the cumulative mechanical energy in the matrix that reaches the rock matrix failure point. The pressure amplitude and time for each pulse is controlled from the surface 105.

A series of joints forming the production casing 200C may be placed along the horizontal portion 186 of the pay zone in the subsurface formation 255, forming a long acoustic device-laden string. Activation of the acoustic devices 230 may arise from signals sent from the surface 105, such as through insulated electric line 260 of FIG. 2A-Y. Alternatively, such signals may arise from use of the electrical contact 265 serving as a transmitter. As the electric contact 265 is pumped downhole, it activates the acoustic devices 230 as it passes by on its way to the toe of the wellbore. Alternatively, the contact 265 activates the acoustic devices 230 as it is pulled up-hole from the toe and passes by the acoustic devices 230.

Activation of these acoustic devices 230 may be done by the operator before a hydraulic fracturing operation is conducted. Alternatively, activation may be done after fracking, or after a period of production from the subsurface formation 255. It is understood that the removal of fluids from the subsurface formation 255 causes pressure depletion, which in turn changes the stress-state of the rock. As the stress state changes, the probability of rock failure increases.

The operator may design the progression or timing of the detonation of the acoustic devices 230. For example, some acoustic devices 230 along the tubular string or production casing 200C are activated prior to fracturing, while others are activated after fracturing, or after a designated amount of pressure depletion. In any instance, where the electric line 260 and contact 265 are used, the speed at which the contact 265 is pumped past the acoustic devices 230 establishes the time between activations, as such the activation frequency.

FIG. 2C-X is a cross-sectional view of the production casing 200C of FIG. 2C. Once again, the view is taken across Line X-X. In this view, acoustic devices 230 are shown residing around the joints, such as the tubular bodies 210 of the production casing 200C. Here, the acoustic devices 230 have been activated. Energy waves 250 are shown moving away from the production casing 200C and into the low-permeability formation, which may be a region of the subsurface formation 255.

As noted, acoustic energy may be applied to the subsurface formation 255 after a hydraulic fracturing operation has been conducted. In one aspect, energy is applied to the subsurface formation 255 at a point where reservoir pressure has depleted by some amount from the original reservoir pressure, such as by at least 10%. In any instance, the acoustic energy generators of the acoustic devices 230 are tuned to generate waveform energy at the resonant frequency of the rock matrix of the subsurface formation 255 within the pay zone.

FIG. 2D is a perspective view of a joint of production casing 200D in a fourth embodiment. In this view, explosive devices 240 are secured to the production casing 200D. Each of the explosive devices 240 comprises an elongated housing residing along an outer diameter of the production casing 200D. The explosive devices 240 are dimensioned to contact or to reside closely adjacent to the surrounding borehole or subsurface formation when the production casing 200D is cemented into place within the wellbore.

Within each of the housings of the explosive devices 240 are charges. The charges represent explosive charges generated by using a length of primer cord and/or a blast cap. Of course, the charges are not accompanied by any actual shots (this is not a perforating gun). Preferably, multiple explosive devices 240 are spaced around the casing body 210, and multiple production casings 200D are connected end-to-end along the wellbore. The explosive devices 240 are then fired together or in sequence along the wellbore.

In this approach, the operator may detonate a series of charges in rapid succession to deliver a high-energy resonant frequency into the formation. In one aspect, the charges are detonated before cementing takes place or, alternatively, before the cement sets in the wellbore. The shockwaves generated by the explosive charges may have any suitable intensity, which also may be referred to as a shockwave pressure. As examples, the shockwave intensity may be at least 150 megapascals (MPa), or at least 500 MPa. The shockwave energy may by applied over any suitable duration, which may be referred to as a shockwave duration. Examples of the shockwave duration include durations of one second, or five seconds, or up to ten seconds.

As with acoustic devices 230, detonation of explosive charges in the explosive device 240 may take place before a hydraulic fracturing operation takes place. Alternatively, detonation of the charges in the explosive device 240 may be done after formation fracturing, or even after a certain period of pressure depletion/fluid production from the wellbore. Some charges in the explosive device 240 along the tubular string or production casing 200D may be detonated before fracturing, and the remainder could be detonated in future detonation events. Where the electrical contact 265 is used, the speed at which the contact 265 is pumped past the charges in the explosive device 240 establishes the time between detonations, as such the activation frequency.

FIG. 2D-X is a cross-sectional view of the production casing 200D. The view is again taken across Line X-X of FIG. 2D. Explosive devices 240 are shown residing around the tubular body 210 of the production casing 200D. Here, the explosive devices 240 have been detonated. Energy waves 250 are shown moving away from the production casing 200D and into the low-permeability formation, such as subsurface formation 255. The shockwave energy (e.g., energy waves 250) is tuned to the resonant frequency of the rock matrix of the subsurface formation 255 within the pay zone.

In addition to the waveform energy generators described above in connection with FIGS. 2A, 2B, 2C and 2D, the operator may also inject piezo-electric material into the perforations. The piezo-electric material in this case is in the form of granules blended into an aqueous medium at the surface. The piezo-electric material may extend at least a short distance through perforations 160 formed in the production casing 200. In this instance, the piezo-electric material may be at the micro-scale or smaller to permit the material to penetrate through the perforations 160 and into the rock pores.

Alternatively, the operator may employ piezo-electric materials as a proppant in connection with hydraulically fracturing of the well. This serves to create a radiator pattern of resonant frequency fractures emanating from the wellbore 150. In this case, the piezo-electric material is blended into the fracturing fluid at the surface as part of an aggregate.

It is also noted that aspects of the waveform energy generators described above in connection with FIGS. 2A, 2B, 2C and 2D may be combined. For example, the waveform energy generators of FIG. 2B (wherein piezo-electric material in the discrete portions 216 is provided as an add-on sleeve or as a pup joint or as portions of the tubular body 210) may be combined with the acoustic devices 230 of FIG. 2C or the explosive devices 240 of FIG. 2D. In this arrangement, the operator may use the acoustic devices 230 or the explosive devices 240 to emit waveform energy into the subsurface formation 255, but then use the piezo-electric material in the discrete portions 216 as the frequency sensors, or "receivers." The same cable or data line (such as line 260) may be used to both transmit the control signal to the acoustic devices 230 or the explosive devices 240 and to receive the feedback signal from the piezo-electric material in the discrete portions 216.

In one aspect, waveform energy is transmitted into the subsurface formation 255 prior to formation fracturing using the discrete portions 216 of sleeves, the acoustic devices 230 or the explosive charges in the explosive device 240, then subsequent waveform energy is transmitted into the subsurface formation 255 through use of the piezo-electric particles of cement column 220 after hydraulic fracturing, or after a period of production.

Figure 2E:
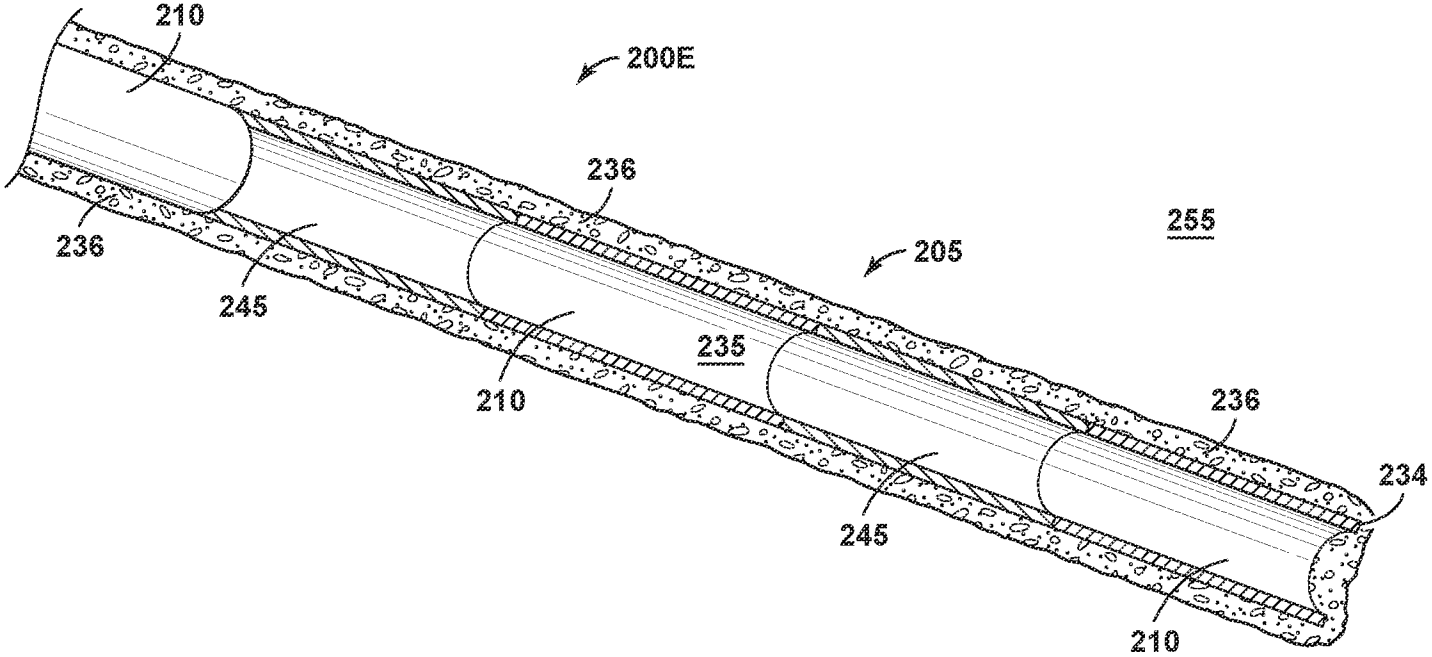
FIG. 2E is a perspective, cutaway view of a string of production casing. Here, the production casing includes joints of tubular bodies fabricated from a piezo-electric material. The production casing has been cemented into a borehole within a pay zone.

Yet an additional method may be used for transmitting waveform energy into the subsurface formation 255. In a fifth method, tubular bodies fabricated from a piezo-electric material are placed in series with standard steel casing joints. FIG. 2E is a perspective, cutaway view of a string of production casing 200E. In this arrangement, the joints, such as tubular bodies 210, are standard, conductive steel casing joints. The production casing 200E includes tubular bodies 245 between the casing joints 210 that are fabricated from a piezo-electric material.

The tubular bodies 245 preferably have the same internal diameter (i.d.) and the same outer diameter (o.d.) as the tubular bodies 210 of the casing joints. Tubular bodies 245 are configured to be threadedly connected in series with the steel casing joints. All joints, which include the tubular bodies 210, 245, are cemented into a borehole 205, as shown by cement column 236. The tubular bodies 245 may be, for example, short subs known as pup joints.

In the arrangement of FIG. 2E, steel casing joints, which include the tubular body 210, and piezo-electric casing joints, which include the tubular body 245, are staggered, and placed threadedly in-line. However, the operator or wellbore designer may place multiple piezo-electric casing joints (e.g., tubular bodies 245) together in series below a last steel casing joint (e.g., tubular body 210). In either instance, the casing joints or tubular bodies 245 with piezo-electric material receive an electric current that is designed to generate mechanical waves into the subsurface formation 255 at the formation's resonant frequency.

Activation of the piezo-electric material in the casing joints or tubular bodies 245 causes the casing joints or tubular bodies 245 themselves to mechanically expand and contract. This is in response to the cyclic transmission of current from the electric activation device, e.g., current sent through a power and/or signal line or signals delivered through a downhole electric transmitter 265. The direction of expansion and contraction depends on the orientation of the piezo-electric particles in the casing joints or tubular bodies 245. Preferably, expansion and contraction takes place longitudinally.

Optionally, cement column 236 includes piezo-electric particles. Providing piezo-electric materials in both the tubular body 245 of a casing joint and in the surrounding cement column 236 allows the piezo-electric particles used in the wellbore completion to directly contact the surrounding rock matrix in the subsurface formation 255. In this way, the wellbore itself becomes an energy generator. In either instance, when energized, the piezo-electric material delivers a waveform energy directly into the rock matrix making up the subsurface formation 255.

Upon activation, the piezo-electric material expands and shrinks based on a voltage applied to the material. The expansion of the piezo-electric material is roughly 0.2% to 0.4% of its length, with a Poisson's ratio of approximately 32% to 34%. The compressive strength of piezo-electric materials can be greater than 120 ksi (827 MPa). Thus, piezo-electric materials can generate thousands of pounds of force. As such, a waveform energy may be delivered into the rock matrix in the subsurface formation 255 at a high electrical-to-mechanical energy conversion.

Figure 2F:
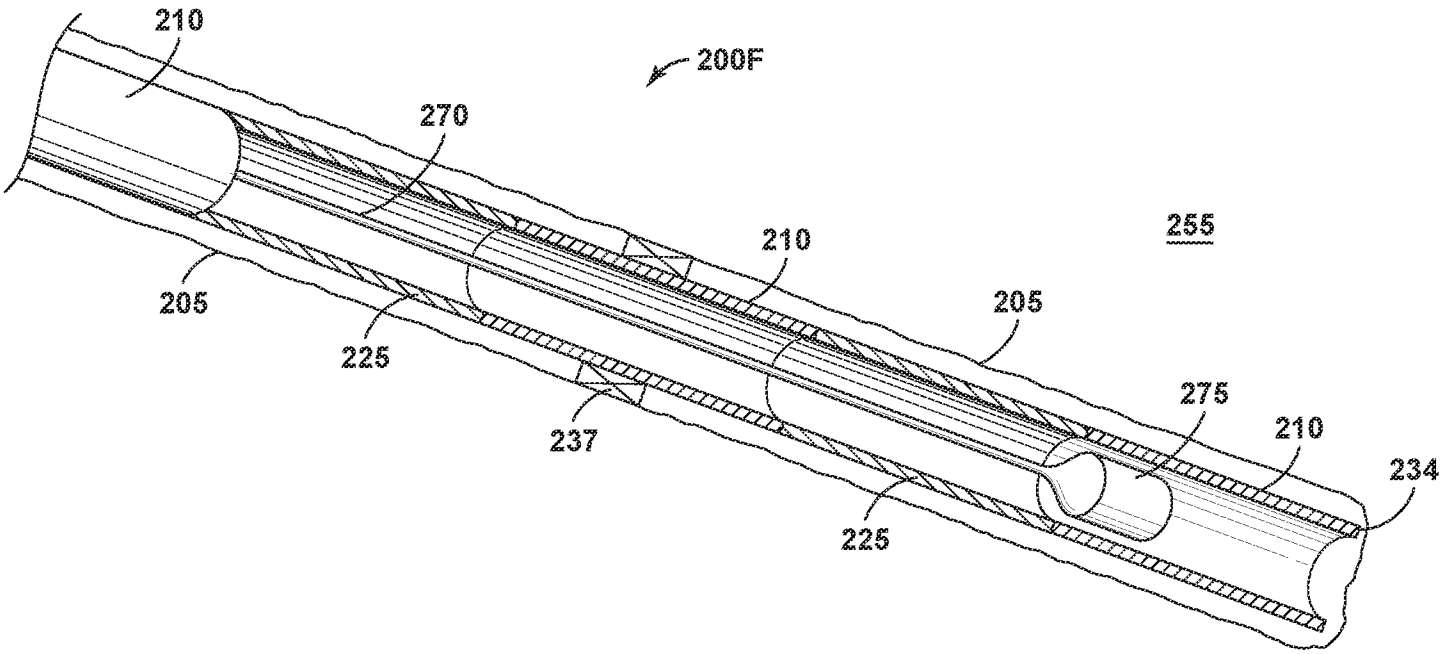
FIG. 2F is another perspective, cutaway view of the string of production casing of FIG. 2E. Here, the production casing is not cemented into the borehole; instead, one or more swell packers are used to isolate zones within the pay zone. An activation device is also shown having been pumped down the production casing en route to the bottom of the wellbore.

FIG. 2F is another perspective, cutaway view of the string of production casing 200E of FIG. 2E. The production casing 200E of FIG. 2E is again shown. However, in this view the production casing 200E is not cemented into the borehole 205; instead, one or more swell packers 237 are used to isolate zones within the pay zone. This is simply for illustrative purposes—the present inventions are not limited to the method of completion except to the extend expressly stated in any claim.

In FIG. 2F, a piezo-electric transmitter 275 is shown having been pumped down the production casing 200E. The transmitter 275 is tethered to the surface 105 by means of a working string 270 or other means of conveyance. In the arrangement of FIG. 2F, the working string 270 is an electric line and the transmitter 275 itself is fabricated from a piezo-electric material. In this case, the transmitter 275 and electric line (e.g., working string 270) are pumped all the way down to the bottom, or toe 234, of the wellbore until the transmitter 275 physically touches the rock formation. This may be done after the well has been completed.

In operation, current is sent through the electric line 270 and down to the transmitter 275 at a designated voltage. This causes that the piezo-electric material in the transmitter to be excited, that is, the material expands and contracts in cycles. In one aspect the piezo-electric material causes the transmitter 275 to become cyclically elongated and contracted, while in another aspect the material causes the transmitter 275 to become cyclically widened and contracted. In either instance, waveform energy is applied directly to the rock matrix.

It is also observed that where a swell packer 237 is used, the tubular bodies of the pipe joints 225 may be fabricated from a piezo-electric material. When a voltage is applied to the tubular bodies of the pipe joints 225, the bodies may expand and contract more freely than if a column of cement was in place.

Returning now to the concept of a wellbore that is cemented in place, including the scenario where the cement column 220 includes piezo-electric particles, it is desirable to improve the mechanical contact of the cement column 220 with the surrounding borehole. To further enhance mechanical contact of the joints of casing 210 and the cement column 220 with the subsurface formation 155, a so-called swage may be placed at the bottom end 234 of a working string. This is done during the well completion stage.

Figure 2G:
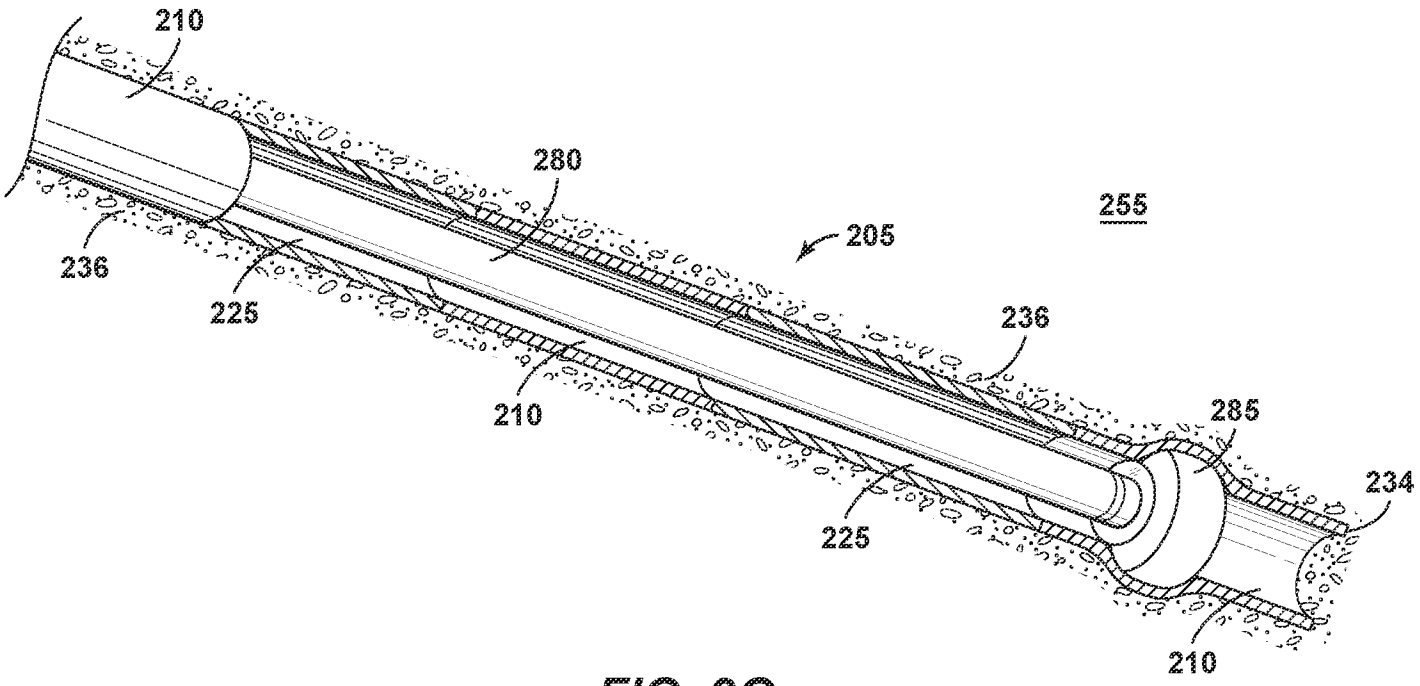
FIG. 2G is still another perspective, cutaway view of the string of production casing of FIG. 2E. A swage has been run into the production casing and is beginning to expand the production casing out into engagement with compliant cement and the surrounding borehole.

FIG. 2G is another perspective, cutaway view of the string of production casing 200E of FIG. 2E. A swage 285 is shown having been run into the production casing 200E at the end of coiled tubing 280. The swage 285 is run into the borehole 205 in an un-activated state. Once in place near the bottom of the wellbore, the swage 285 is activated in any manner known in the art.

Once in place, and as shown in FIG. 2G the swage 285 is activated. Activation of the swage 285 causes the swage 285 to expand and to engage the production casing 200E. Further, the swage 285 expands the production casing 200E and surrounding cement column 236 out into engagement with the borehole 205. The swage 285 is then pulled back up the wellbore in its expanded state. This serves to expand the joints of production casing 260 and surrounding cement column 236, at least along a desired borehole section (such as a horizontal leg 186 in FIG. 1). Where cross-coupling cable clamps are used, the clamps are also expanded into fixed engagement with the borehole 205.

It is noted that casing expansion is a proven oilfield technology that can increase the casing diameter up to approximately 20%. Expansion is done after the cement has been squeezed into the annular region around the production casing to form the cement column 220, but before it has set. Note that the use of a swage is suitable for use with production casing 200A, 200B or 200E.

FIG. 2H is yet another perspective, cut-away view of the string of production tubular body 210 of the casing of FIG. 2E. In this arrangement, a mechanical device 290 is used to transmit waveform energy into the surrounding subsurface formation 255. The mechanical device 290 is secured to an outer diameter of the casing (e.g., tubular body 210).

FIG. 2H-Z presents an enlarged view of a portion of the string of production casing having a tubular body 210 from FIG. 2H. Features of the mechanical device 290 from FIG. 2H are more clearly seen.

The mechanical device 290 first includes a body 292, which may also be referred to as a housing. The body 292 is fabricated from a rigid and sturdy material suitable for the high pressure environment within the borehole 205. Examples include steel and ceramic. In the arrangement of FIG. 2H-Z, the body 292 is eccentric.

The body 292 defines an open cavity 294. Within the cavity 294 is a block of piezo-electric material 295. The piezo-electric material resides on a fulcrum 296. The fulcrum 296 is pinned to the housing 292 by means of pin 297.

Opposite the piezo-electric material 295 and external to the housing 292 is a borehole contact pad 298. The borehole contact pad 298 is fixed to an end of the fulcrum 296 such as by means of pins 299. The borehole contact pad 298 is configured to vibrate against the borehole 205 in response to activation of the piezo-electric material 295, such as through transmission of electrical activation signals into the housing 292. Stated another way, the mechanical device 290 serves as an energy generator that is configured to transmit waveform energy into the subsurface formation 255 around the wellbore or borehole 205 at a resonant frequency of a rock matrix making up the subsurface formation 255 in response to control signals. Preferably, a number of mechanical devices are aligned along the production casing (e.g., tubular body 210) at designated intervals and depths.

The benefit of using the mechanical device 290 over the placement of piezo-electric material into a tubular body or into a cement column or through a sleeve is that the piezo-electric material 295 is safely encased in a metal housing 292 to protect it and to help convert its mechanical energy into something of greater amplitude and impact. It is understood that the mechanical device of FIG. 2H-Z is illustrative, and that other arrangements for a mechanical device where vibratory energy is transmitted from piezo-electric material against the borehole wall may be provided.

Each of the waveform energy generators described above can be part of a system for generating waveform energy. Each system may include a string of production casing, an activation device and a waveform energy device, or more preferably a plurality of waveform energy devices. The activation device may reside inside of the casing, outside of the casing, or in some cases both. The waveform energy device itself resides outside of the production casing or is a part of the production casing or may be deployed internal to the production casing such that it mechanically engages to casing or to the toe of the well to deliver the resonant frequency directly to the formation. Pipe joints 225 are energized using the electric contact 265 in response to the transmission of power through an e-line 260. Alternatively or in addition, a piezo-electric transmitter 275 is run into the wellbore at the end of an e-line (electric line 270) until the transmitter 275 is in contact with the formation at the bottom of the wellbore.

In one aspect, the system includes a plurality of wellbores, with each wellbore having a string of production casing, an activation device and a plurality of waveform energy devices. In any instance, a system is provided wherein electrical energy is delivered to piezo-electric material that is essentially in direct contact with the rock matrix in the subsurface formation 255, converting electrical energy into mechanical energy.

Figure 3:
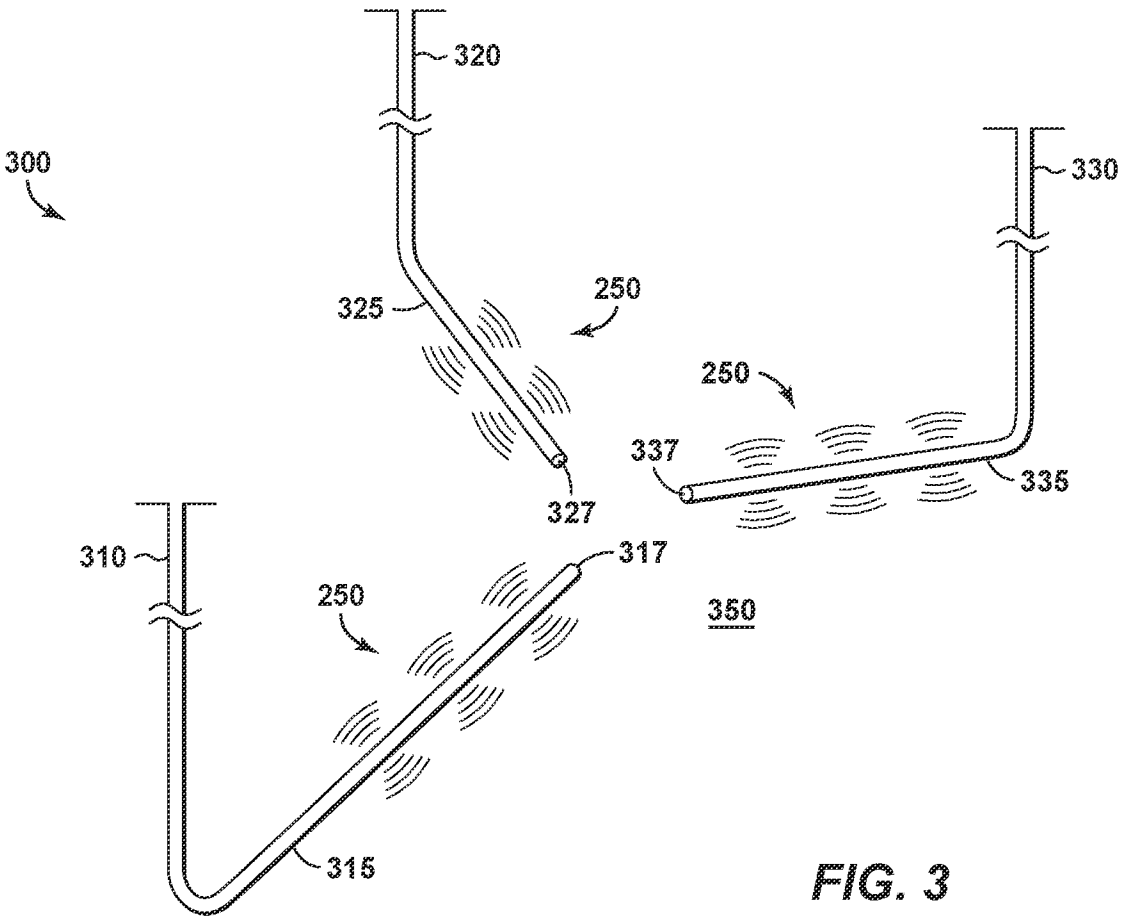
FIG. 3 is a perspective view of a portion of a field undergoing hydrocarbon production activities. Three illustrative wellbores are shown, with each wellbore having been completed to have a horizontal section, or leg. Waveform energy is being broadcast into the formation from each wellbore.

FIG. 3 is a perspective view of a portion of a field 300 undergoing hydrocarbon production activities. Three illustrative wellbores 310, 320, 330 are shown. In the illustrative arrangement of FIG. 3, each wellbore 310, 320, 330 has been completed to have a horizontal section, or leg. Wellbore 310 has horizontal section 315; wellbore 320 has horizontal section 325; and wellbore 330 has horizontal section 335.

Each wellbore 310, 320, 330 has been completed with a waveform energy generator. In accordance with the present disclosure, each wellbore 310, 320, 330 itself becomes a waveform generator due to direct contact of waveform or mechanical energy with the respective boreholes.

In the view of FIG. 3, energy generators in each wellbore 310, 320, 330 have been activated. Waveform energy of the energy waves 250 is shown emanating from each of the horizontal sections 315, 325, 335. In the arrangement of FIG. 3, the horizontal sections 315, 325, 335 are generally at the same depth along a pay zone 350. In addition, each of the horizontal sections 315, 325, 335 is oriented inward such that a toe 317, 327, 337 of each respective horizontal section 315, 325, 335 is in proximity to a shared point within the pay zone 350. However, it is understood that the horizontal sections 315, 325, 335 may be parallel to each other and may be aligned horizontally or vertically. It is further understood that spacing between wellbores is regulated by state oil and gas agencies (such as the Texas Railroad Commission or the Oklahoma Corporation Commission).

In any arrangement, the field 300 is designed so that activation of the waveform energy generators in each wellbore 310, 320, 330 enhances permeability in the pay zone 350. Activation of the waveform energy generators may be done before pay zone 350 the formation is perforated and fractured, after the pay zone 350 in the formation is perforated and fractured, after the wellbores 310, 320, 330 have been producing for a period of time, or combinations thereof. In one aspect, the operator may choose to wait until a neighboring well has produced for a period of time or has contributed to pressure depletion such that the stress-state in formation adjacent the new well is favorably modified.

In FIG. 3, current is applied by an electrical transmitter (such as downhole transmitter 265) to an energy generator. The electrical current is tuned to provide amplitudes and frequencies that react with the resonant frequency of the adjacent formation and associated pay zones 350. This serves to loosen existing fissures and fractures that may be cemented together, significantly enhancing formation permeability.

Figure 4:
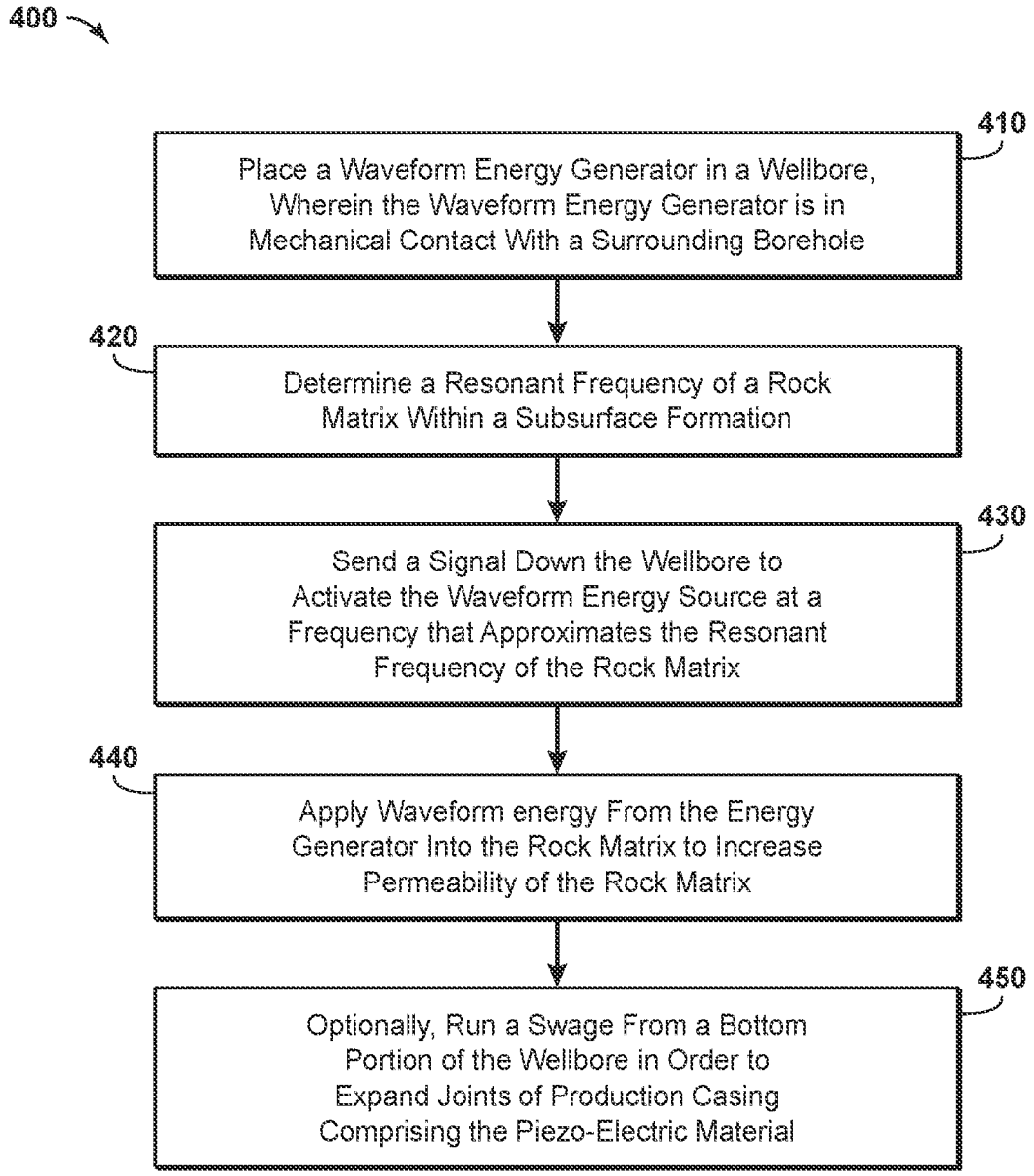
FIG. 4 is a flow chart showing steps for a method of enhancing permeability in a subsurface formation, in a first embodiment.

Based on the waveform energy generation systems described above, a method of enhancing permeability of a rock formation is provided herein. FIG. 4 presents a flow chart showing steps for a method 400 of enhancing permeability in a rock formation, in one embodiment.

The method 400 first comprises placing a piezo-electric material into a wellbore. This is provided at Box 410, which includes placing a waveform energy generator in a wellbore, wherein the waveform energy generator is in mechanical contact with a surrounding borehole (or subsurface formation). The piezo-electric material is part of a waveform energy generator. The waveform energy generator may be in accordance with any of the energy generation systems described above. In these arrangements, the waveform energy generator resides outside of the production casing or is a part of the production casing. Other embodiments may have the waveform generator conveyed inside the well and mechanically engaged to the production casing walls to create the resonant frequency for a pre-determined length of time. The waveform energy generator is in mechanical contact with the surrounding borehole, either directly or through a thin surrounding cement column. (For purposes of the present disclosure, "mechanical contact" includes both circumstances.)

The wellbore may be horizontally completed, as shown with any of wellbores 310, 320, 330 described above. Alternatively, the wellbore may be completed vertically. Preferably, the waveform energy generator is provided within a low-permeability rock matrix.

The method 400 also includes determining a resonant frequency of the rock matrix within a surrounding subsurface formation. This is shown at Box 420, which includes determining a resonant frequency of a rock matrix within a subsurface formation. The step of Box 420 may be done by correlating a known resonant frequency with the lithology identified in the formation. More preferably, this is done by transmitting wave energy into the formation, and then listening for, or detecting, vibrational frequencies within the formation using a piezo-electric sensor. The vibrational frequencies are carried to the surface and are then filtered to identify a resonant frequency within the formation.

The method 400 also comprises sending a signal down the wellbore to activate a waveform energy generator. This is seen at Box 430, which includes sending a signal down the wellbore to activate the waveform energy source at a frequency that approximates the resonant frequency of the rock matrix. The waveform energy source generates frequencies into the subsurface formation at a frequency that approximates the resonant frequency of the rock matrix.

It is noted that the step of Box 420 may be repeated for different zones along a horizontal leg to confirm that the resonant frequency is the same across the pay zone. If there are variations in resonant frequency, then activations signals sent in Box 430 representing different currents may need to be used.

The method 400 additionally includes applying waveform energy from the energy generator into the rock matrix. This is provided in Box 440, which includes applying waveform energy from the energy generator into the rock matrix to increase permeability of the rock matrix. The step of Box 440 is done to break up naturally occurring fractures and to move rock features towards or past a failure point. This increases the effective permeability of the rock matrix.

As noted above, most all unconventional formations reside in a tectonically induced anisotropic stress-state, that is, the stresses in one direction of the formation are different from the stresses imposed in other directions. This inherent stress anisotropy aids in the creation of cracks and fissures due to the stress gradients naturally positioning the rock closer to its failure point. The resonance induced mechanical energy delivery pushes the strained/stressed rock beyond its failure point (shear or tensile). The most readily accessible failure points are natural fractures that are critically stressed (i.e., residing near their failure point). Subsequent weak points become compromised with increasing mechanical energy accumulation in the rock, thus creating a more extensive permeability-enhancing crack network.

The method 400 may further and optionally include running a swage across a selected portion of the production casing. This is shown in Box 450, which includes, optionally, running a swage from a bottom portion of the wellbore in order to expand joints of production casing comprising the piezo-electric material. In operation, the swage is placed at the bottom end of the production casing string during the well completion stage. The swage is then pulled back up the wellbore in an expanded state, using a working string. This serves to expand the production casing and surrounding cement column into engagement with the rock matrix, at least along a desired borehole section.

Regardless of the type of energy applied, in one method the operator monitors production and formation pressure in one or more neighboring wells. As a neighboring well becomes depleted, this indicates to the operator that the in situ stress state of the formation has become favorably modified. The operator may then apply the shockwave energy or the acoustic energy or the vibrational energy (all of which represent forms of the waveform energy) into the pay zone from a producing well.

As a variation of the method 400, and particularly the step of Box 410, the operator may run a waveform energy generator into the wellbore at the end of a working string. The working string may be a string of drill pipe, an e-line (as shown at 270 in FIG. 2F) or a string of coiled tubing. The waveform energy generator is in the form of a piezo-electric transmitter 275. The energy generator is run to the toe of the wellbore until it is in mechanical contact with the end of the well. This is done after the well has been completed. Optionally, this modified version of Box 410 is done after the well has been producing hydrocarbon fluids for a period of time. In this way, waveform energy may be applied directly to the rock matrix of the formation at the toe of the well. Beneficially, in this embodiment the energy generator can later be removed from the well and then used in another well.

In another aspect of the method, the operator monitors the geomechanics of the subsurface formation to determine if the rock matrix is in a critically-stressed state. For example, if injector wells are injecting water into a field, either as part of a salt water disposal (SWD) operation or for water flooding/enhanced oil recovery (EOR), the formation can become critically stressed. The operator may wait until such a point has been reached to begin sending the control signal down to the waveform energy generator. This point may be determined, for example through geomechanical modeling or through active seismic monitoring.

Figure 5A:
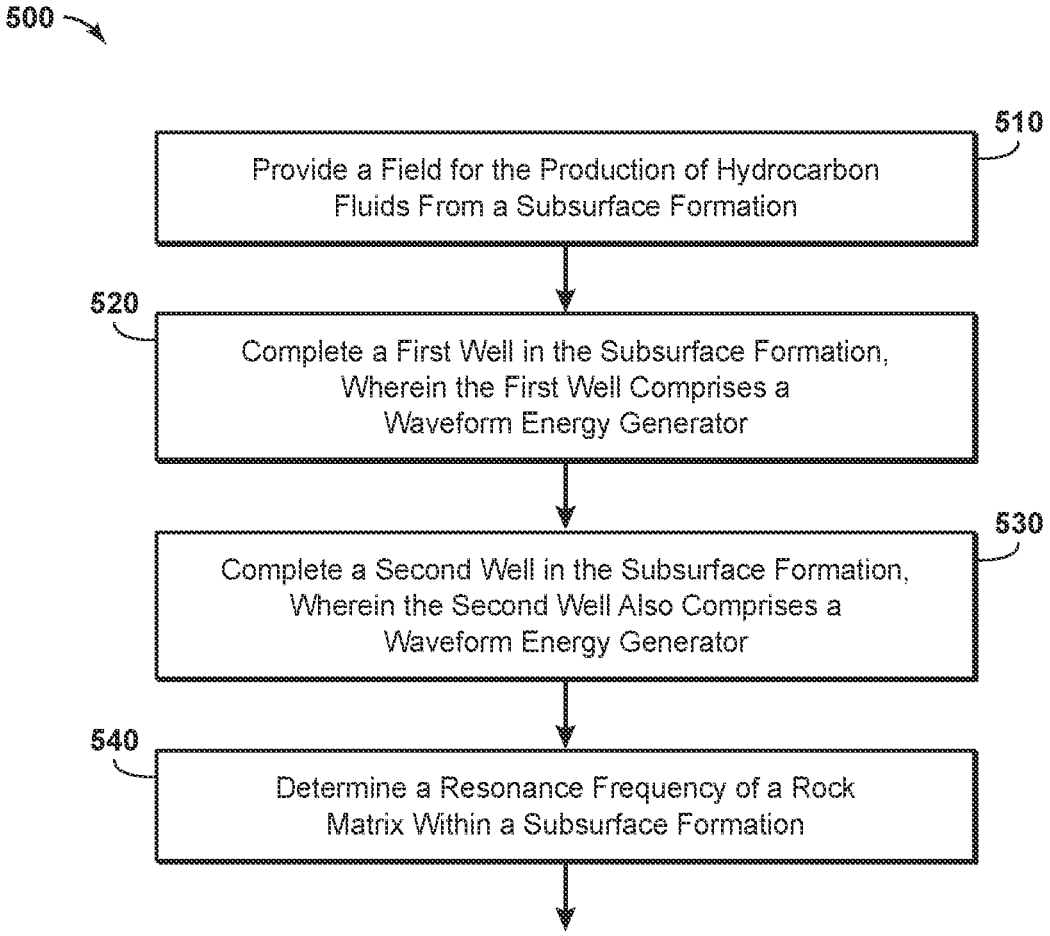
FIGS. 5A and 5B provide a single flow chart showing steps for a method of enhancing permeability in a subsurface formation, in a second embodiment.
Figure 5B:
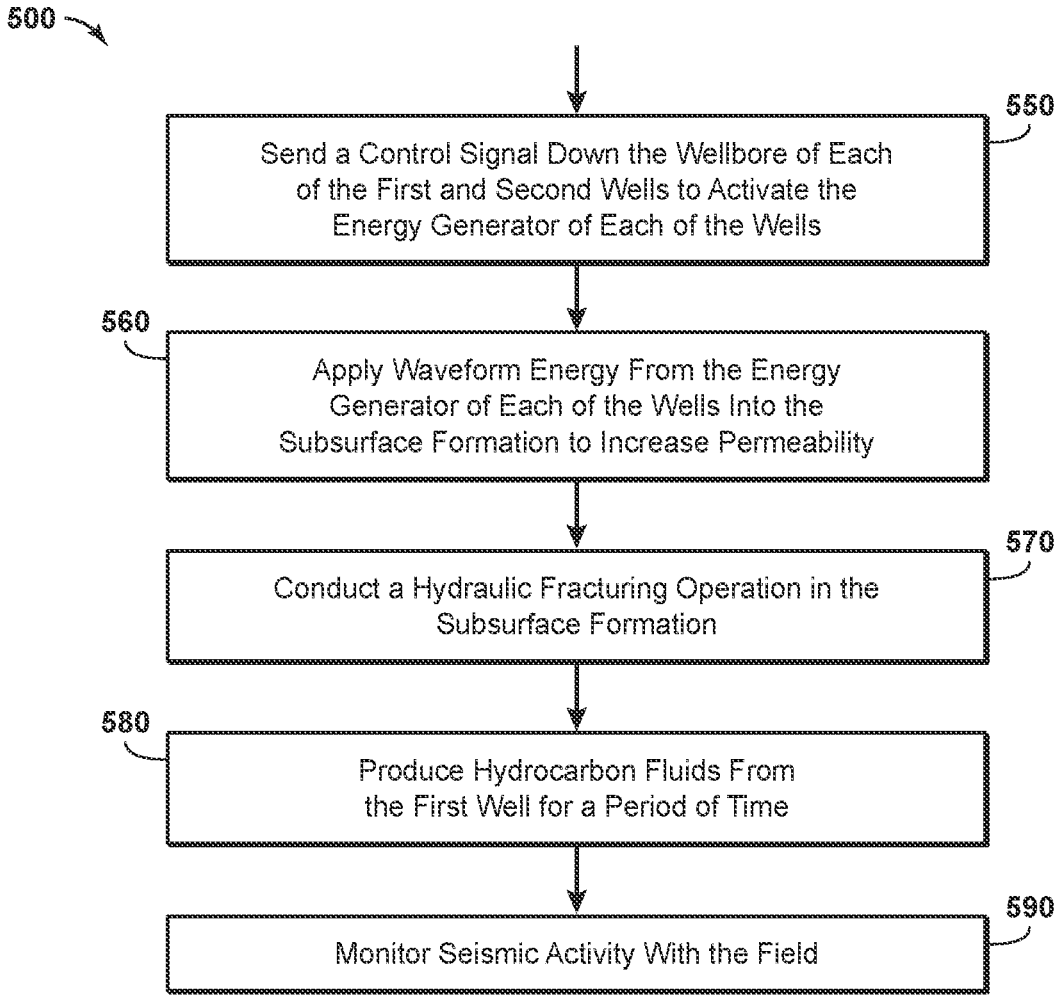

FIGS. 5A and 5B provide a single flow chart showing steps for a method 500 of enhancing permeability in a subsurface formation, in an alternate embodiment.

The method 500 first comprises providing a field for the production of hydrocarbon fluids. This is shown at Box 510, which includes providing a field for the production of hydrocarbon fluids from a subsurface formation. In this step, hydrocarbon fluids are produced from a subsurface formation, with the subsurface formation having a rock matrix. The step of providing a field may mean that an operator obtains mineral rights from a landowner or governmental agency, or otherwise obtains lawful access to a field. The field may be located below land, or may be a subsea field. The step of providing a field may alternatively mean that a service company contracts with a mineral rights owner or operator to provide well completion or remediation services.

The method 500 next includes completing a first well in the subsurface formation. This is provided in Box 520, which includes completing a first well in the subsurface formation, wherein the first well comprises a waveform energy generator.

The method 500 further includes completing a second well in the subsurface formation. This is shown in Box 530, which includes completing a second well in the subsurface formation, wherein the second well also comprises a waveform energy generator.

In the steps of each of Boxes 520 and 530, each of the first and second wells comprises a wellbore. Preferably, each wellbore is completed to have a horizontal section. Each wellbore has received a waveform energy generator (or system of energy generators) residing along the production casing. Of interest, the energy generator of each of the first and second wells is in mechanical contact with a borehole along its respective wellbore. Note that for purposes of this disclosure, "mechanical contact" may mean that the waveform energy generator is close enough (such as within one inch) of a surrounding borehole that it is able to propagate mechanical waves into the borehole and rock matrix without actually touching, or without actually touching the borehole along an entire section of borehole wherein the mechanical energy is applied.

The method 500 additionally comprises determining a resonant frequency of a rock matrix within the subsurface formation. This is seen at Box 540, which includes determining a resonance frequency of a rock matrix within a subsurface formation. The step of Box 540 may be done by correlating a known resonant frequency with the lithology identified in the subsurface formation. More preferably, this is done by transmitting wave energy into the formation, and then listening for, or detecting, vibrational frequencies within the formation using a piezo-electric sensor. The vibrational frequencies are transmitted to the surface and are then filtered to identify a resonant frequency for the rock matrix.

The method 500 further includes sending a control signal down the wellbore of each of the first well and the second wells. This is provided in box 550, which includes sending a control signal down the wellbore of each of the first and second wells to activate the energy generator of each of the wells. Sending the control signals activates the waveform energy generators of each of the first and second wells. Sending a control signal may mean sending electrical current down a wire embedded within a string of coiled tubing. Alternatively, sending a control signal may mean sending electrical current down a wire residing along an outer diameter of the joints of casing.

The method 500 next comprises applying waveform energy from the energy generators of each of the first and second wells. This is seen at Box 560, which includes applying waveform energy from the energy generator of each of the wells into the subsurface formation to increase permeability. The waveform energy is sent into the subsurface formation at a resonant frequency of the rock matrix within the subsurface formation. The effect is to increase the effective permeability of the rock matrix.

Note that the term "effective permeability" is broader than the idea of changing the permeability of the rock matrix itself. Applying energy at the resonant frequency of the rock matrix opens natural fissures and fractures that may have otherwise been closed off by the presence of cementitious material. Applying energy may also loosen cracks that were previously at a failure point, causing sheer failure, tensile failure or both. The result is that formation fluids are able to flow more readily towards the pressure sink presented by the wellbores in the first and second wells.

The energy generators in the first and second wells may be in accordance with the waveform energy generators described above, in any of their embodiments. Preferably, the waveform energy generator of each of the first and second wells resides along respective joints of production casing. The joints of production casing in each of the first and second wells comprise tubular bodies threadedly joined end-to-end. In one aspect, certain of the joints themselves are fabricated from a piezo-electric material.

The control signals are sent via a signal transmission system extending from a surface down to the joints of production casing associated with each of the first and second wells. The signal transmission system is preferably an electrical cable that extends down an outer diameter of the casing strings in the wellbores, secured by clamps. Alternatively, sending a control signal may mean sending current down an electrical line and to an electric contact that has been lowered into the wells.

In one embodiment, the waveform energy generator in each of the first and second wells comprises (i) joints of casing fabricated from a piezo-electric material and forming the tubular body, (ii) a piezo-electric material placed within a column of cement residing between the joints of production casing and the borehole, (iii) piezo-electrically activated mechanical devices such as sleeves or pads along the tubular string, or (iv) combinations thereof, of the respective first and second wells. Applying the waveform energy from each energy generator comprises sending electrical current down to the tubular bodies.

In another embodiment, the waveform energy generator in each of the first and second wells comprises one or more of explosive devices disposed around the outer diameter of the tubular bodies. In this instance, applying the waveform energy from the energy generator comprises detonating the one or more explosive devices. Preferably, waveform energy generators are detonated in series along a distance of at least 1,000 feet of length along the wellbore.

In yet another embodiment, the waveform energy generator in each of the first and second wells comprises one or more of acoustic devices disposed around the outer diameter of the tubular body or, optionally, along the tubular body. In this instance, applying the waveform energy from the energy generator comprises activating the acoustic devices along an extended length of the production casing.

The waveform energy may be applied from the energy generator of each of the first and second wells into the rock matrix over a period of time. A step in the method 500 may include determining a length of time, or a cycle of time, in which to apply mechanical energy into the formation. Preferably, the application of energy is designed to deliver continuous cumulative growth of trapped mechanical energy (via the resonant frequency) until matrix failure occurs.

The method 500 additionally includes conducting a hydraulic fracturing operation in the subsurface formation. This is indicated at Box 570, which includes conducting a hydraulic fracturing operation in the subsurface formation. The hydraulic fracturing operation may be conducted from the wellbore of the first well (i) before applying waveform energy from the energy generators of each of the first and second wells, (ii) after applying waveform energy from the energy generators of each of the first and second wells, or (iii) both.

Optionally, a hydraulic fracturing operation is conducted in the subsurface formation from the second well after applying waveform energy from energy generators of the second well but before applying waveform energy from energy generators of the first well.

The method 500 further includes producing hydrocarbon fluids from the first well for a period of time. This is seen at Box 580, which includes producing hydrocarbon fluids from the first well for a period of time. Typically, production takes place after the waveform energy has been applied to the subsurface formation in each well. However, in one aspect waveform energy is sent from the energy generators of (i) the first well, (ii) the second well, or (iii) both, after the period of time of production.

It is observed that pressure depletion from offset well production within a pay zone's reservoir fluids can significantly weaken the in situ stress profile of the rock matrix. Stated another way, reservoir depletion that has occurred as a result of production operations in a wellbore reduces pore pressure in the formation, which reduces the principal horizontal stress of the rock matrix itself. The weakened rock fabric now superimposes a new "path of least resistance" for high pressure frac fluids. This means that fractures and fracturing fluids may now try to migrate toward pressure depleted areas formed by adjacent wells. For this reason, as part of the method 500 the operator may choose to apply mechanical energy (including shockwave energy or acoustic energy) in lieu of fracturing, or in lieu of fracturing at full fluid volume capacity, when an offset well has shown signs of depletion or is vulnerable to experiencing a pressure hit. This may minimize the possibility of frac hits.

Finally, the method 500 may include monitoring seismic activity within the field from the surface. This is shown in Box 590, which includes monitoring seismic activity with the field. Optionally, the operator may discontinue the application of waveform energy into the subsurface formation in the event seismic activity is detected.

As can be seen, a method for enhancing permeability of a subsurface formation is provided. Beneficially, the method employs in situ waveform energy generators that may be turned on and turned off at any time before or after completion or before or after production. Further still, the wellbore itself becomes the waveform energy generator by activating the generators along one or more strings of production casing in virtual contact with the surrounding borehole or subsurface formation. There is no need to run a separate tool into the wellbore to generate wave energy, although this is an option in certain embodiments. The method has particular applicability to so-called unconventional formations.

Further variations of the energy generators and the methods of enhancing formation matrix permeability herein may fall within the spirit of the claims, below. It will be appreciated that the inventions are susceptible to modification, variation and change without departing from the spirit thereof.

While the present techniques may be susceptible to various modifications and alternative forms, the examples discussed above have been shown only by way of example. However, it should again be understood that the present techniques are not intended to be limited to the particular examples disclosed herein. Indeed, the present techniques include all alternatives, modifications, and equivalents falling within the true spirit and scope of the appended claims.

What is claimed is:

1. A waveform energy generation system for a subsurface formation, comprising:

at least one joint of production casing placed within a wellbore;

an energy generator that comprises a piezo-electric material placed within a column of cement residing along the at least one joint of production casing and configured to be in substantial mechanical contact with the subsurface formation; and wherein the energy generator is configured to transmit waveform energy produced by the column of cement into the subsurface formation at a resonant frequency of a rock matrix making up the subsurface formation in response to control signals.

2. The waveform energy generation system of claim 1, further comprising:

a signal transmission system for sending control signals to the energy generator within the wellbore for activation.

3. The waveform energy generation system of claim 2, wherein:

the at least one joint of production casing further comprises a series of steel casing joints threaded end-to-end, and extending at least 500 feet along the wellbore;

the energy generator comprises one or more sub joints placed threadedly in-line with the series of steel casing joints; and each of the one or more sub joints is fabricated from metal having internal piezo-electric material such that the one or more sub joints generates waveform energy in response to the control signals.

4. The waveform energy generation system of claim 2, wherein:

the energy generator comprises a plurality of unarmed perforating guns, with each perforating gun residing within a separate housing fixed along one of the at least one joint of production casing; and the energy generator further comprises (i) one or more radial sleeves slidably placed along an outer diameter of each of the at least one joint of production casing, or (ii) one or more pads fixed along an outer diameter of each of the at least one joint of production casing, configured to sense frequencies returning from the rock matrix following activation of the unarmed perforating guns downhole, and generate electrical signals corresponding to said frequencies.

5. The waveform energy generation system of claim 2, wherein the signal transmission system comprises:

an electric line; and an electric probe at a distal end of the electric line for transmitting electrical energy to the waveform energy generator upon reaching a location of the energy generator.

6. The waveform energy generation system of claim 5, wherein the electric probe (i) delivers control signals by contacting a joint of steel casing supporting the energy generator, or (ii) by passing by the energy generator either while the electric probe is being pumped down the wellbore or while the electric probe is being pulled up the wellbore.

7. The waveform energy generation system of claim 2, wherein:

the signal transmission system comprises an electric cable residing on an outer diameter of a string of steel production casing placed within the wellbore;

the electric cable extends down the wellbore to a depth of the energy generator; and the waveform energy generation system further comprises a plurality of clamps spaced apart along the string of steel production casing for securing the electric cable to the outer diameter of the string of production casing.

8. The waveform energy generation system of claim 2, wherein the signal transmission system comprises (i) electro-magnetic material within a string of production casing within the wellbore, or (ii) acoustic energy transmission nodes configured to transmit electric signals from the surface to the energy generator.

9. The waveform energy generation system of claim 2, wherein:

the energy generator comprises one or mechanical devices that is radially fixed along an outer diameter of each of the at least one joint of production casing; and each of the one or more mechanical devices comprises:

a housing having an internal cavity;

a piezo-electric material residing within the internal cavity; and a borehole contact pad external to the housing and acted upon by the piezo-electric material such that the borehole contact pad delivers resonant frequency energy into the subsurface formation in response to the control signals.

10. The waveform energy generation system of claim 1, wherein:

the column of cement resides between the at least one joint of production casing and the subsurface formation, such that the column of cement itself generates waveform energy in response to the control signals.

11. The waveform energy generation system of claim 1, wherein:

the at least one joint of production casing comprises a tubular body;

the tubular body is threadedly connected in series with joints of casing; and the tubular body is fabricated at least in part from a piezo-electric material such that the tubular body itself generates waveform energy in response to the control signals.

12. The waveform energy generation system of claim 1, wherein:

the energy generator comprises one or more pads that is radially fixed along an outer diameter of each of the at least one joint of production casing; and each of the one or more pads is fabricated from metal having internal piezo-electric material such that the pads deliver resonant frequency energy into the subsurface formation in response to the control signals.

13. The waveform energy generation system of claim 1, wherein:

the energy generator comprises one or more radial sleeves slidably placed along an outer diameter of each of the at least one joint of production casing; and each of the one or more radial sleeves is fabricated from a piezo-electric material such that the one or more radial sleeves generates waveform energy in response to the control signals.

14. The waveform energy generation system of claim 13, wherein the at least one joint of production casing and the one or more radial sleeves have been expanded in the wellbore into mechanical contact with the subsurface formation.

15. The waveform energy generation system of claim 14, wherein the column of cement works with the radial sleeves to generate waveform energy.

16. A method of enhancing permeability within a subsurface formation, comprising:

placing a waveform energy generator in a wellbore, the energy generator comprising a piezo-electric material placed within a column of cement that is in mechanical contact with a borehole along the wellbore;

determining a resonant frequency of a rock matrix within the subsurface formation; and applying waveform energy produced by the column of cement into the rock matrix to increase effective permeability of the rock matrix.

17. The method of claim 16, further comprising:

sending a control signal down the wellbore to activate the waveform energy generator at a frequency that approximates the resonant frequency of the rock matrix;

and wherein:

the wellbore comprises at least one joint of production casing;

the control signal is sent via a signal transmission system extending from a surface down to the at least one joint of production casing; and the waveform energy generator resides along the at least one joint of production casing.

18. The method of claim 17, wherein:

the column of cement resides between the at least one joint of production casing and the subsurface formation.

19. The waveform energy generation system of claim 17, wherein:

the at least one joint of production casing comprises a tubular body;

the tubular body is threadedly connected in series with joints of steel casing; and the tubular body is fabricated at least in part from a piezo-electric material such that the tubular body itself generates waveform energy in response to the control signals.

20. The method of claim 17, wherein:

the energy generator comprises (i) one or more pads radially fixed along an outer diameter of each of the at least one joint of production casing, or (ii) one or more radial sleeves slidably placed along an outer diameter of each of the at least one joint of production casing; and each of the one or more pads or each of the one or more radial sleeves is fabricated from a piezo-electric material such that the one or more pads or the one or more radial sleeves generates resonant frequency energy into the subsurface formation in response to the control signals.

21. The method of claim 17, wherein the at least one joint of production casing comprises a series of casing joints threaded end-to-end, and extending at least 500 feet along the borehole.

22. The method of claim 17, further comprising:

expanding the at least one joint of production casing into engagement with the subsurface formation.

23. The method of claim 17, wherein:

the column of cement resides between the at least one joint of production casing and the borehole; and the method further comprises:

expanding the at least one joint of production casing into engagement with the subsurface formation before the column of cement sets.

24. The method of claim 17, wherein:

the energy generator comprises a plurality of explosive devices, with each explosive device residing within a separate housing fixed along the at least one joint of production casing; and applying the waveform energy from the energy generator comprises detonating the explosive devices in response to the control signals.

25. The method of claim 24, wherein:

the plurality of explosive devices are detonated in series;

sending a control signal down the wellbore comprises sending a signal down an electric line within a bore of the wellbore;

an electric probe resides at a distal end of the electric line for transmitting electrical energy from the electric line to the waveform energy generator; and the method further comprises passing the electric probe across the explosive devices downhole.

* * * * *